US006219020B1

(12) United States Patent
Furuhashi et al.

(10) Patent No.: US 6,219,020 B1
(45) Date of Patent: Apr. 17, 2001

(54) LIQUID CRYSTAL DISPLAY CONTROL DEVICE

(75) Inventors: Tsutomu Furuhashi, Yokohama; Hiroyuki Mano, Sagamihara; Naruhiko Kasai, Yokohama; Satoru Tsunekawa, Higashimurayama; Hiroshi Kurihara, Mobara; Hiroyuki Nitta, Fujisawa; Hirofumi Koshi, Chiba-ken; Yoshihisa Oishi, Yokohama; Nobutaka Kato, Owariasahi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/500,237

(22) Filed: Feb. 8, 2000

Related U.S. Application Data

(63) Continuation of application No. 08/891,751, filed on Jul. 14, 1997, which is a continuation-in-part of application No. 08/770,373, filed on Nov. 29, 1996.

(30) Foreign Application Priority Data

Nov. 30, 1995 (JP) ..... 7-312483
May 11, 1996 (JP) ..... 8-292857
Jul. 17, 1996 (JP) ..... 8-187480

(51) Int. Cl.[7] ..... G09G 3/36; G09G 5/00
(52) U.S. Cl. ..... 345/100; 345/132
(58) Field of Search ..... 345/132, 100, 345/87–104

(56) References Cited

U.S. PATENT DOCUMENTS 4,481,511 11/1984 Hammura et al. ..... 345/100
4,990,904 2/1991 Zenda ..... 345/3
5,061,920 10/1991 Nelson ..... 345/89
5,138,305 8/1992 Tomiyasu ..... 345/3
5,162,786 11/1992 Fukada ..... 345/208

(List continued on next page.)

FOREIGN PATENT DOCUMENTS 04-12393 1/1992 (JP) .

*Primary Examiner*—Jeffery Brier
*Assistant Examiner*—Anthony Blackman
(74) *Attorney, Agent, or Firm*—Mattingly, Stanger & Malur, P.C.

(57) ABSTRACT

A liquid crystal display device of the present invention capable of enlarging and displaying to a high picture quality even when display data having a lower resolution than a liquid crystal panel is inputted is provided with storage element groups every drain line within latches of a liquid crystal driver. A portion of the storage element groups simultaneously captures display data. In doing so, the same liquid crystal apply voltage is outputted from drain lines corresponding to these storage element groups. Storage element groups corresponding to neighboring drain lines then simultaneously capture display data so as to enlarge an image in the horizontal direction. The rate of enlargement can be regulated by changing the number of storage element groups simultaneously capturing display data. A scanning driver then simultaneously selects a plurality of rows with a select voltage being applied to the simultaneously selected rows of pixel elements in the same period so as to enlarge the image in the vertical direction. Enlarged displaying is therefore possible by the liquid crystal driver regulating an output period of the liquid crystal apply voltage even when rows are selected one at a time.

5 Claims, 35 Drawing Sheets

U.S. PATENT DOCUMENTS

| | | | |
|---|---|---|---|
| 5,289,173 | 2/1994 | Numao | 345/87 |
| 5,351,064 | 9/1994 | Zenda | 345/3 |
| 5,406,308 | 4/1995 | Shiki | 345/127 |
| 5,448,259 | 9/1995 | Hidaka | 345/99 |
| 5,475,437 | 12/1995 | Song | 345/130 |
| 5,508,714 | 4/1996 | Zenda | 345/3 |
| 5,571,603 | 11/1996 | Kelley et al. | 428/212 |
| 5,638,088 | 6/1997 | Mano et al. | 345/95 |
| 5,644,329 | 7/1997 | Asari et al. | 345/89 |
| 5,648,790 | 7/1997 | Lee | 345/58 |
| 5,689,280 | 11/1997 | Asari et al. | 345/89 |
| 5,699,074 | 12/1997 | Sutherland et al. | 345/90 |
| 5,719,594 | 2/1998 | Potu | 345/130 |
| 5,784,037 | 7/1998 | Inoue | 345/87 |
| 5,815,128 | 9/1998 | Hoshino et al. | 345/89 |
| 5,844,539 | 12/1998 | Kitagawa | 345/100 |

INPUTTED DISPLAY DATA

LIQUID CRYSTAL PANEL DISSPLAY DATA

INPUTTED DISPLAY DATA

LIQUID CRYSTAL PANEL DISPLAY DATA

INPUTTED DISPLAY DATA

LIQUID CRYSTAL PANEL DISPLAY DATA

INPUTTED DISPLAY DATA

LIQUID CRYSTAL PANEL DISPLAY DATA

LIQUID CRYSTAL DISPLAY CONTROL DEVICE

The present application is a continuation application of U.S. Ser. No. 08/891,751, filed Jul. 14, 1997 pending, which is a continuation-in-part application of U.S. patent application Ser. No. 08/770,373 filed Nov. 29, 1996 which is currently pending.

BACKGROUND OF THE INVENTION

1. Field of the Invention

The present invention relates to a liquid crystal display and more particularly relates to a liquid crystal driver capable of enlarging and displaying a low resolution image signal on a liquid crystal panel.

2. Description of Related Art

A description of a related liquid crystal display will be given using FIG. 2 to FIG. 5.

FIG. 2 is a block diagram of a related liquid crystal driver. FIG. 3 is a timing chart showing the operation of a related liquid crystal driver. FIG. 4A and FIG. 4B are block diagrams of liquid crystal displays employing related liquid crystal drivers.

In FIG. 2, numeral 101 indicates a data bus for transmitting display data. Numeral 102 indicates a clock CL2 synchronized with the display data of the display data bus 101. Further, numeral 103 indicates a display data capture start signal El, numeral 104 indicates a horizontal synchronization signal CL1 generated every horizontal period and numeral 105 indicates a reference gradation voltage that is a reference for a gradation voltage outputted by this liquid crystal driver. Moreover, numeral 201 indicates a shift register, numeral 202 indicates a latch signal group generated by the shift register 201, numeral 203 indicates a data latch, numeral 204 indicates a data bus for transmitting line data outputted by the data latch 203, numeral 205 indicates a line data latch for simultaneously capturing line data transmitted by the data bus 204, numeral 206 indicates a data bus for transmitting line data outputted by the line data latch 205, numeral 207 indicates a gradation voltage generator for generating a gradation voltage from the data bus 206 and the reference gradation voltage 105 and numeral 208 indicates a signal line group (hereinafter referred to as a "drain line group") for transmitting the gradation voltage generated by the gradation voltage generator 207.

In FIG. 4A and FIG. 4B, numeral 401 indicates a data bus for transmitting display data supplied from a system (not shown in the drawings) and a synchronization signal. Numeral 402 indicates a controller for generating display data and timing signals etc. for liquid crystal driving use based on display data and synchronization signals transmitted via the data bus 401. Further, numeral 403 indicates a liquid crystal driver, numeral 404 and 404' indicate scanning drivers, numeral 405 indicates a power supply and numeral 406 and 406' indicate liquid crystal panels. Moreover, numeral 407 indicates a data bus for transmitting liquid crystal display data and timing signals supplied to the liquid crystal driver 403 from the controller 402, numeral 408 indicates a data bus for transmitting signals for controlling the scanning driver 404 and numeral 409 indicates a signal line for transmitting an alternating signal supplied to the power supply 405. Numeral 410 indicates a signal line group (hereinafter referred to as a "drain line group") for transmitting gradation voltages generated by the liquid crystal driver 403. Numeral 411 indicates a signal line group (hereinafter referred to as a "gate line group") for transmitting line select/de-select voltages generated by the scanning driver 404. Numeral 412 indicates a power supply line for transmitting a reference voltage for the line select/de-select voltage generated by the power supply 405 to the scanning driver 404. Numeral 413 indicates a power supply line for transmitting a voltage that is a reference for the gradation voltages generated by the liquid crystal driver 403. Numeral 414 indicates a power supply line for providing a voltage to opposing electrodes of the liquid crystal panel 406. Numeral 418 indicates supplementary capacitors provided in order to prevent voltage leakage from the liquid crystal 417. Numeral 415 indicates a power supply line for supplying a voltage to the supplementary capacitors 418 of the liquid crystal panel 406. Numeral 416 indicates a "Thin Film Transistor" (hereinafter abbreviated to "TFT") for carrying out a switching operation. Numeral 417 indicates a liquid crystal which is described as a condenser.

The details of the liquid crystal display of FIG. 4A are described based on FIG. 2 and FIG. 3. Here, a description is given with a 640 pixel portion of valid display data being transmitted to the liquid crystal driver.

When the display data capture start signal 103 is valid, the shift register 201 sequentially puts the latch signal group 202 to valid (refer to FIG. 3) in accordance with the clock 102 synchronized with the display data to be transmitted by the display data bus 101.

The data latch 203 then captures the display data by sequentially latching the display data transmitted via the display data bus 101 in accordance with the latch signal group 202. The display data stored at the data latch 203 also appears at the data bus 204 as shown in FIG. 3 because the latch signal group 202 is generated in synchronization with the display data transmitted via the display data bus 101.

When the horizontal synchronization signal 104 becomes valid, the line data latch 205 simultaneously captures the display data stored at the data latch 203 via the data bus 204. The line data latch 205 then transmits this captured display data to the gradation voltage generator 207 via the data bus 206. The gradation voltage generator 207 then generates gradation voltages in response to this display data and outputs the gradation voltage via the drain line group 208 (410).

When one horizontal line portion of display data is stored at the line data latch 205, the shift register 201 and the data latch 203 start the operation to catch display data for the next line. The above operation is then sequentially repeated during displaying.

The conditions for the liquid crystal driver of this related example to carry out displaying will be described together with a further driving circuit using FIG. 4A.

In FIG. 4A, the controller 402 converts the display data and synchronization signal transmitted from the system bus 401 into display data for liquid crystal driver use and each of the various timing signals and supplies this data and the various signals to the appropriate parts. The liquid crystal driver 403 then captures the display data in sequence and generates and outputs a gradation voltage corresponding to display data for one horizontal line portion. The liquid crystal driver 403 has already been described using FIG. 2 and FIG. 3.

The scanning driver 404 applies a select voltage or de-select voltage to the gate line group 411 in synchronization with the output of the gradation voltage, i.e. the scanning driver 404 applies a select voltage to the gate line connected to the first line while the liquid crystal driver 403 outputs a gradation voltage corresponding to the display data of the first line, with a de-select voltage being applied to gate lines of the remaining lines. TFTs 416 of pixel parts for the first line then become selected and a gradation voltage transmitted via a signal line of the drain line group 410 is applied to liquid crystals 417 and supplementary capacitors 418 of pixels of the first line.

Next, a select voltage is applied to the gate line connected to the second line when the liquid crystal driver 403 outputs a gradation voltage corresponding to display data for a second line. The gradation voltage is therefore applied to the TFTs of the pixels for the second line in the same way as for the first line. A de-select voltage is then applied to the gate lines of the first line and the remaining lines. The TFT 416 of the first line therefore goes off and the load (i.e. the applied gradation voltages) accumulated at the liquid crystal 417 and supplementary capacitors 418 for each of the pixel parts is stored.

Gradation voltages corresponding to display data for one picture portion can then be applied to all of the pixel parts by repeating the above operation while sequentially changing the line to which a select voltage is applied.

The operation of the related liquid crystal display shown in FIG. 4B is also basically the same as the liquid crystal display of FIG. 4A. However, with the liquid crystal panel 406' utilized in the liquid crystal display of FIG. 4B, the supplementary capacitors 417 of the pixel parts put on by the TFT 416 are connected to a separate neighboring gate line and a selection voltage therefore cannot be applied simultaneously to two neighboring gate lines.

With related liquid crystal displays, however, the picture becomes unsightly when the resolution of inputted valid display data and the resolution of the liquid crystal panel do not coincide. This problem is described in detail using FIG. 5.

In the example shown in FIG. 5, valid display data of 640 horizontal pixels and 480 vertical lines is shown on a liquid crystal display having 1024 horizontal pixels and 768 vertical lines.

As only a 640 pixel portion of display data is transmitted in the horizontal direction, the shift register 201 (refer to FIG. 2) of the liquid crystal driver 403 only puts a 640 pixel portion of the latch signal group 202 as being valid. Portions corresponding to latch signal groups 202 thereafter for the data latch 203, line data latch 205 and gradation voltage generator 207 are therefore not inputted as valid display data. Displaying is therefore not possible for regions for which this latch signal is not valid.

Further, only a 480 line portion of display data is transmitted in the vertical direction. Display data for the following frame therefore gets transmitted during the operation of selecting the gate lines of the lower part of the displayed picture. The image to be displayed at the upper part of the picture in the next frame therefore gets displayed at the lower part of the picture for the current frame, causing a problem.

SUMMARY OF THE INVENTION

It is therefore the object of the present invention to provide a liquid crystal display device capable of enlarging and displaying display data with a high picture quality even when the display data inputted is of a lower resolution than a liquid crystal panel.

In order to achieve the aforementioned object, in a first aspect of the present invention there is provided a liquid crystal display device comprising a liquid crystal panel with pixel parts equipped with liquid crystals being arranged in M rows and N columns; a liquid crystal driver, inputted with display data, for generating a liquid crystal apply voltage in response to the inputted display data and applying the liquid crystal apply voltage to columns of the pixel parts corresponding to the display data; and a scanning driver, for sequentially selecting any one of the rows, applying a select voltage to a pixel part of a row selected at this time and applying a de-select voltage to pixel parts of rows not selected at this time, the liquid crystal driver being equipped with a plurality of drain signal lines for outputting the liquid crystal apply voltage; storage means, having a plurality of storage element groups provided every drain signal line for capturing and storing the display data at specially decided times and for simultaneously outputting the stored display data; and a voltage generator, for changing display data outputted by the storage means to the liquid crystal apply voltage, with a portion of the storage element groups simultaneously capturing the display data.

Here, it is preferable for the corresponding drain lines of the storage element group simultaneously capturing the display data to be neighboring drain lines.

It is also preferable for the liquid crystal display device to further comprise changing means for changing the number of storage element groups simultaneously capturing the display data.

In a second aspect of the present invention, there is provided a liquid crystal display device comprising a liquid crystal panel with pixel parts equipped with liquid crystals being arranged in M rows and N columns; a liquid crystal driver, inputted with display data, for generating a liquid crystal apply voltage in response to the inputted display data, and applying the liquid crystal apply voltage to columns of the pixel parts corresponding to the display data; and a scanning driver, for sequentially selecting any one of the rows, applying a select voltage to a pixel part of a row selected at this time; and applying a de-select voltage to pixel parts of rows not selected at this time, with the scanning driver simultaneously selecting a plurality of rows and applying the select voltage to the pixel parts of the simultaneously selected rows in the same period.

Here, it is preferable for simultaneously selected rows to be neighboring rows.

The liquid crystal display device can also comprise selected line number hanging means for changing a number of lines simultaneously selected by the scanning driver.

In a third aspect of the present invention, there is provided a liquid crystal display device comprising a liquid crystal panel with pixel parts equipped with liquid crystals being arranged in M rows and N columns; a liquid crystal driver, inputted with display data, for generating a liquid crystal apply voltage in response to the inputted display data, and applying the liquid crystal apply voltage to columns of the pixel parts corresponding to the display data; and a scanning driver, for sequentially selecting any one of the rows, applying a select voltage to a pixel part of a row selected at this time, and applying a de-select voltage to pixel parts of rows not selected at this time, with the liquid crystal driver having a first data generator for increasing a number of items of display data in the horizontal direction, and outputting the display data by generating display data for interpolated pixels by subjecting display data neighboring in the horizontal direction to arithmetic operation processing.

In a fourth embodiment of the present invention, there is provided a liquid crystal display device comprising a liquid crystal panel with pixel parts equipped with liquid crystals being arranged in M rows and N columns; a liquid crystal driver, inputted with display data, for generating a liquid crystal apply voltage in response to the inputted display data, and applying the liquid crystal apply voltage to columns of the pixel parts corresponding to the display data; and a scanning driver, for sequentially selecting any one of the rows every n/m (where n<m and n and m are integers) periods of a horizontal frequency period, applying a select voltage to a pixel part of a row selected at this time and applying a de-select voltage to pixel parts of rows not selected at this time, with the liquid crystal driver having a second data generator for generating display data for interpolated pixels by subjecting n items of display data neighboring in the vertical direction to arithmetic processing operations and outputting a total of m items of display data neighboring in the vertical direction.

It is preferable for the liquid crystal driver to have a first data generating circuit for increasing a number of items of display data in the horizontal direction and outputting the display data by generating display data for interpolated pixels by subjecting display data neighboring in the horizontal direction to arithmetic processing operations.

In the third and fourth aspects, it is preferable for the arithmetic processing operations to multiply values for display data for neighboring pixels with pre-decided coefficients for each pixel, and to add the results.

In a fifth aspect of the present invention, there is provided a liquid crystal display device comprising a liquid crystal panel with pixel parts equipped with liquid crystals being arranged in M rows and N columns and a plurality of row signal lines and column signal lines connected to the pixel parts; a liquid crystal controller for capturing a display data synchronization signal and generating a liquid crystal driving synchronization signal based on the synchronization signal; a scanning driver for sequentially selecting each row of the liquid crystal panel so as to select all rows in the same period as a period for sending one picture portion of the display data in accordance with the liquid crystal driving synchronization signal, applying a select voltage to selected rows of pixel parts via the row signal lines and applying de-select voltages to remaining pixel parts; and a liquid crystal driver, equipped with storage means for capturing and storing the display data in accordance with the liquid crystal driving synchronization signal, for generating a liquid crystal apply voltage for displaying a display expressing the display data at pixel parts being applied with the select voltage based on display data for one row portion stored at the storage means, and applying the liquid crystal apply voltage to the pixel parts via the column signal lines, with the liquid crystal driver applying a liquid crystal apply voltage to the pixel parts based on the same one row portion of display data in a period of the scanning driver selecting a plurality of pre-decided neighboring rows.

Here, the storage means of the liquid crystal driver can comprise a first storage circuit for sequentially storing the captured display data in pixel units, a second storage circuit for simultaneously capturing and storing one row portion of display data stored at the first storage circuit in the same period as the period for storing one row portion of the display data at the first storage circuit, and a third storage circuit for simultaneously capturing and storing one row portion of display data stored in the second storage circuit during switching of the row selected by the scanning driver, with the liquid crystal driver generating the liquid crystal apply voltage based on display data stored by the third storage circuit, and the period of the third storage circuit capturing display data being shorter than the period of the first storage circuit storing one row portion of the display data.

Moreover, means for changing a ratio a:b (where a and b are integers fulfilling a≧b) of a period of the first storage circuit storing one row portion of the display data and a period of the third storage circuit capturing display data can be further provided.

Further, the liquid crystal driver can apply a liquid crystal apply voltage to pre-decided neighboring pluralities of columns of pixel parts based on one pixel portion of display data corresponding to a prescribed column within the one row portion of display data stored by the storage means.

Still further, means for changing the pre-decided neighboring plurality of columns and a prescribed column of display data for the one row portion of display data can be further provided.

The operation will now be described, starting with the operation of the first and second aspects.

The liquid crystal driver generates a liquid crystal apply voltage in response to inputted display data. This voltage is then applied to the columns of pixel parts corresponding to the display data, i.e. each of the element groups capture and store the display data at specially decided times. The stored display data is then simultaneously outputted. The voltage generator then changes the display data outputted by the storage means to a liquid crystal apply voltage for outputting via a drain signal line.

The scanning driver then sequentially selects one of the rows and a select voltage is applied to the pixel part of the row selected at this time, with de-select voltages being supplied to pixel parts for rows that are not selected.

In this case, a portion of the storage element group simultaneously captures the display data. In doing so, the same liquid crystal apply voltage is outputted from drain lines corresponding to this portion of the storage element group. An image can then be horizontally enlarged by storage element data groups corresponding to neighboring drain lines simultaneously capturing display data. The rate of enlargement can then be regulated by the changing means changing the number of storage elements within the storage element groups that are simultaneously capturing display data.

The scanning driver simultaneously selects a plurality of lines and select voltages are applied to pixel parts of the simultaneously selected lines in the same period. The image can then be enlarged in the vertical direction by simultaneously selecting neighboring rows. The rate of enlargement can then be regulated by changing the number of rows simultaneously selected using a select row number means.

The operation of the third and fourth aspect will now be described.

The liquid crystal driver generates a liquid crystal apply voltage in response to the inputted display data, with this being applied to columns of pixel parts corresponding to the display data. In this case, the first data generator of the liquid crystal driver generates display data for interpolated pixels by subjecting display data neighboring in the horizontal direction to arithmetic processing operations so as to increase the number of items of display data in the horizontal direction (i.e. enlargement in the horizontal direction) for outputting. Further, the second data generator generates display data for interpolated pixels by subjecting n items of display data neighboring in the vertical direction to arithmetic processing operations so as to output display data for a total of m items of display data neighboring in the vertical direction. Enlargement in the vertical direction of m/n times can therefore be achieved. These arithmetic processing operations can be achieved by, for example, multiplying values for display data for neighboring pixels with predecided coefficients every pixel and adding the results.

The scanning circuit sequentially selects any one of the rows and applies a select voltage. In this case, the period for selecting one row corresponds to m/n times that for the vertical direction, with the horizontal period being a period of n/m times (where n<m and n and m are integers). De-select voltages are then applied to pixel parts for rows that are not selected at this time.

DETAILED DESCRIPTION OF THE PREFERRED EMBODIMENTS

First Embodiment

Figure 1:
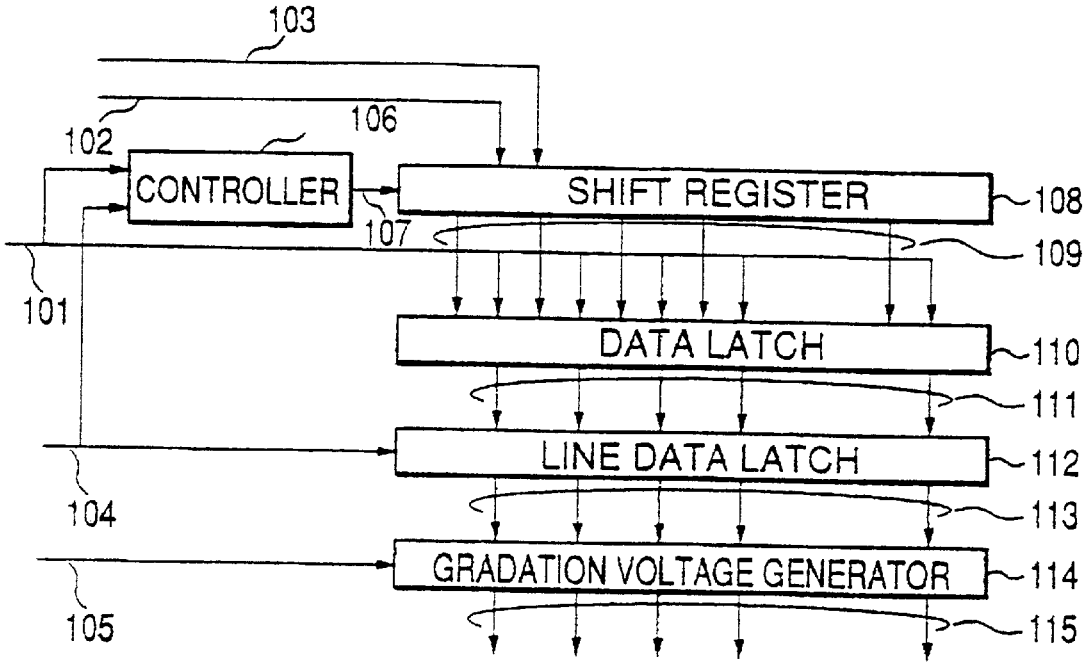
FIG. 1 is a block diagram of the configuration of a liquid crystal driver of a first embodiment of the present invention.
Figure 4A:
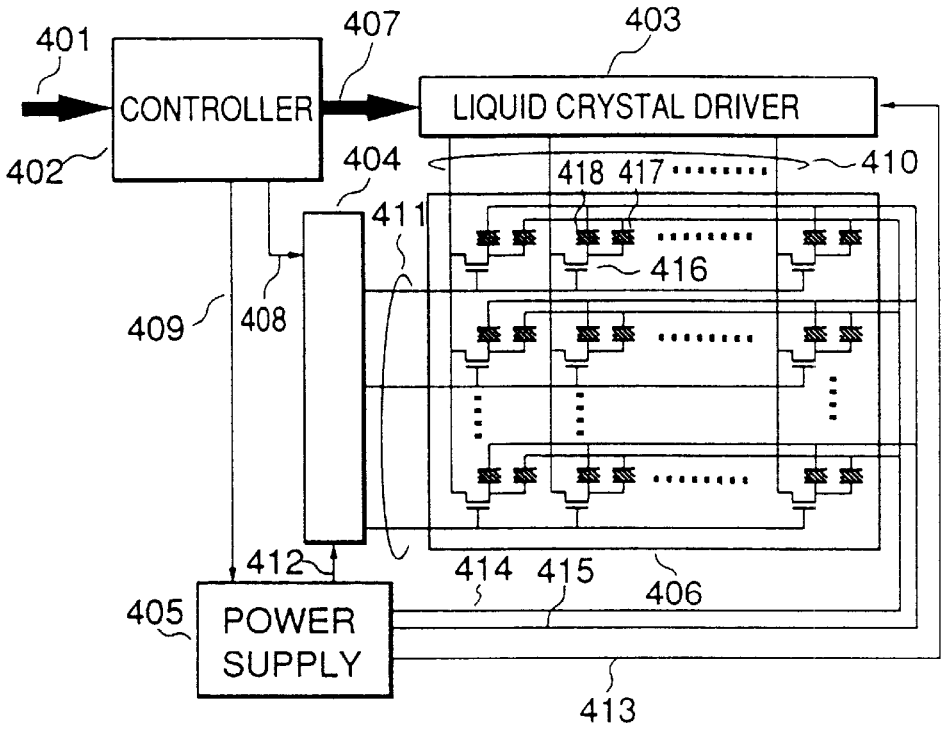
FIG. 4A and FIG. 4B are block diagrams of TFT_liquid crystal modules used in related liquid crystal drivers.
Figure 4B:
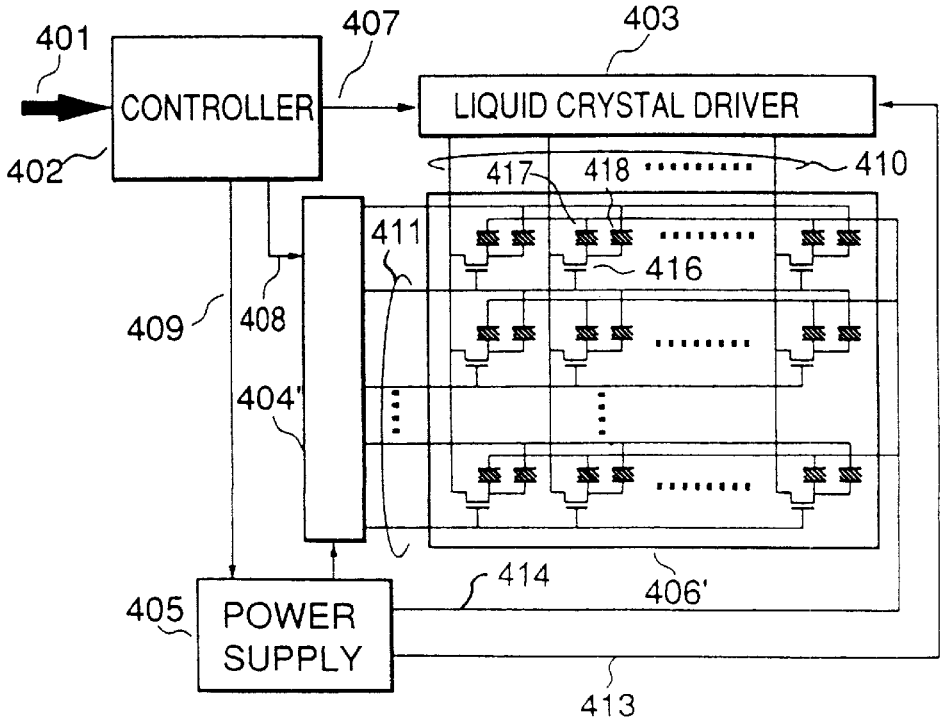
Figure 5:
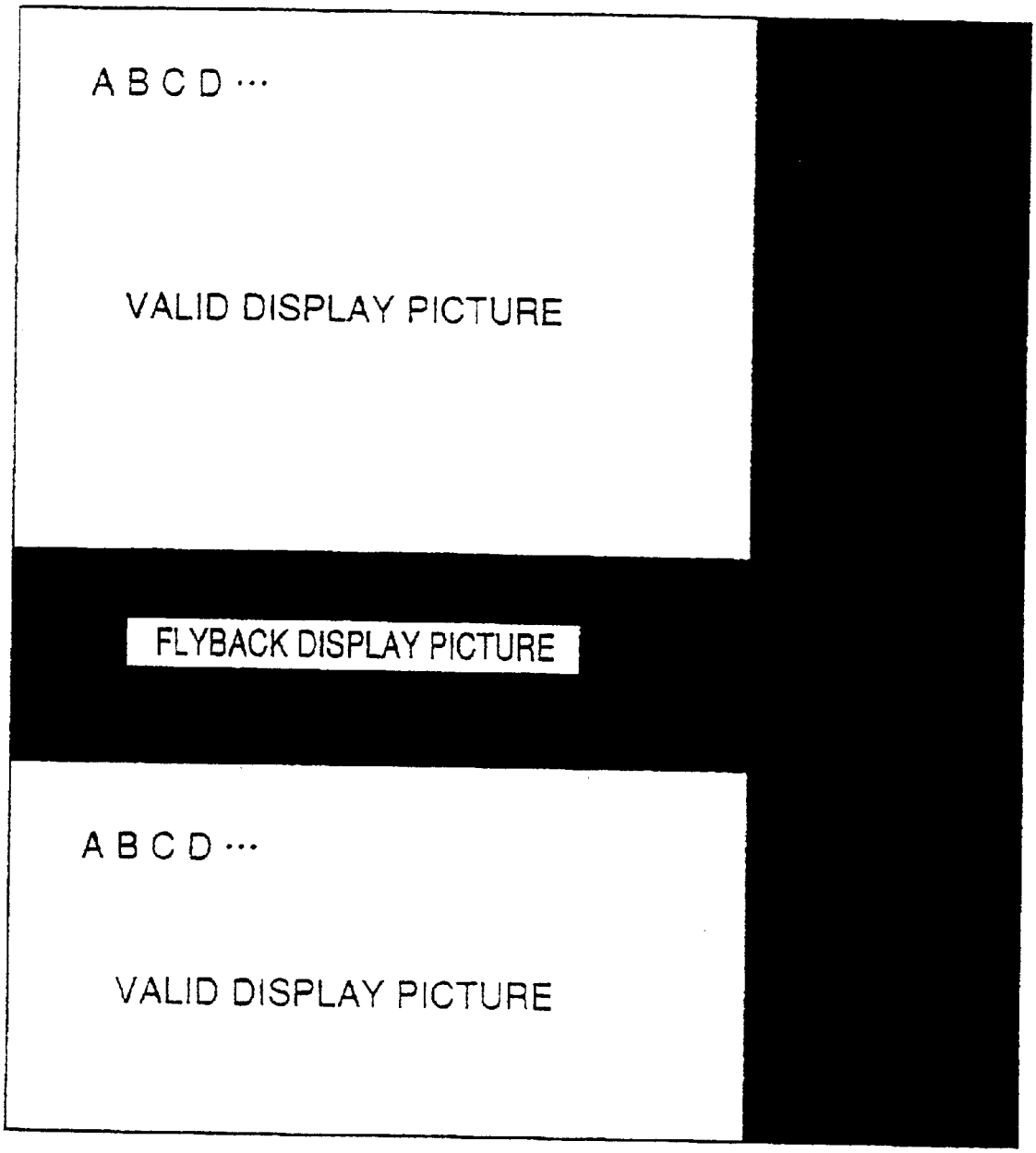
FIG. 5 is a view showing an example of a related display.
Figure 6:
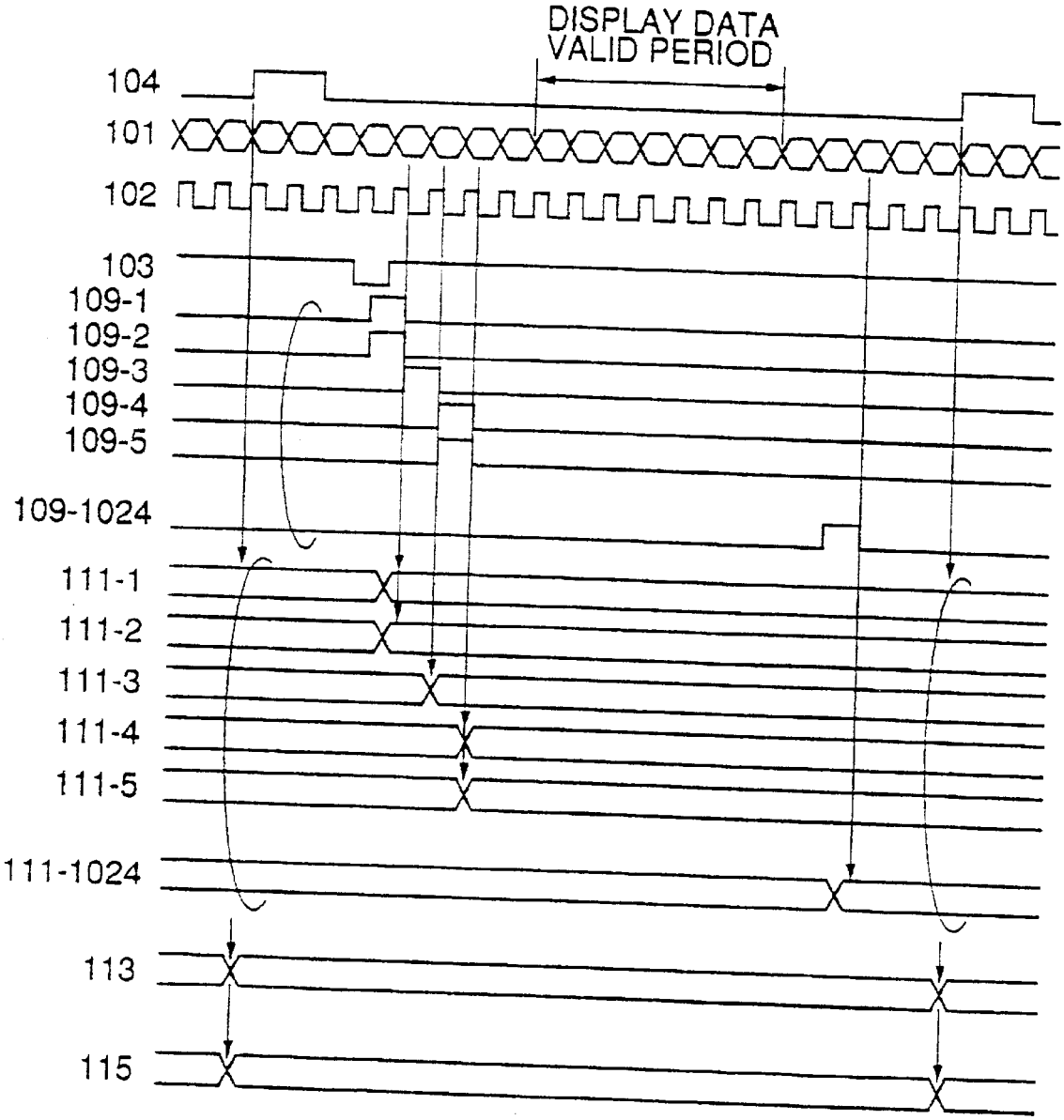
FIG. 6 is a timing chart showing the operation of a liquid crystal driver of a first embodiment of the present invention.
Figure 7:
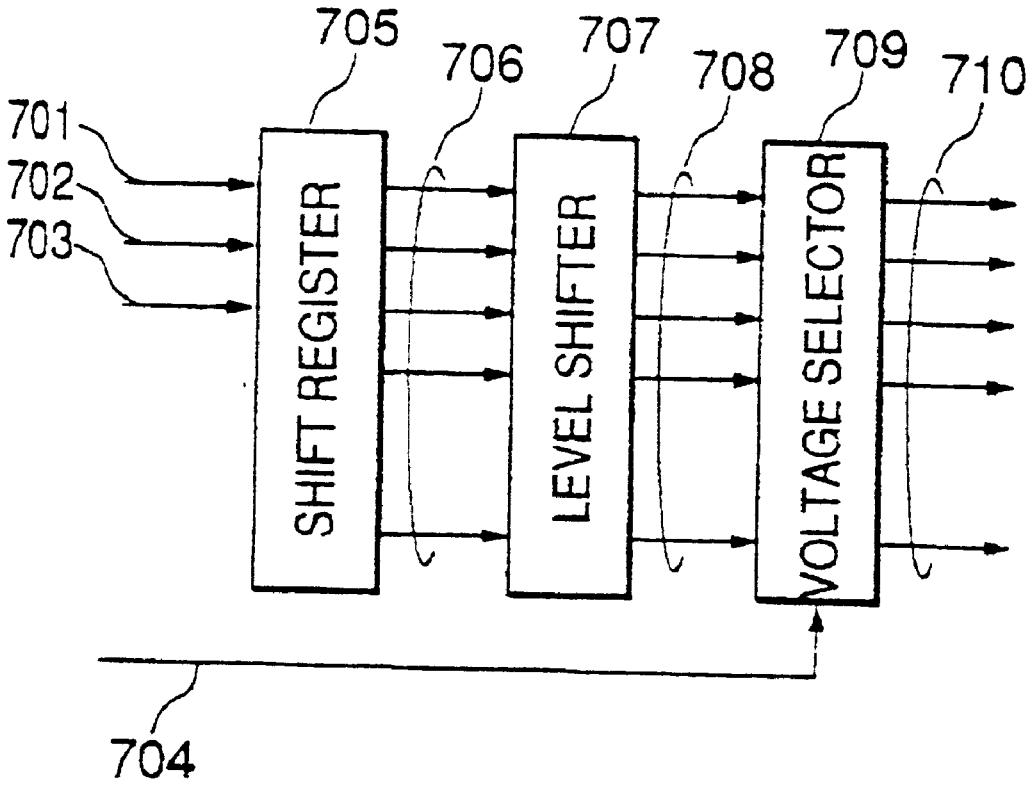
FIG. 7 is a block diagram showing the configuration of a scanning driver of the first embodiment.
Figure 8:
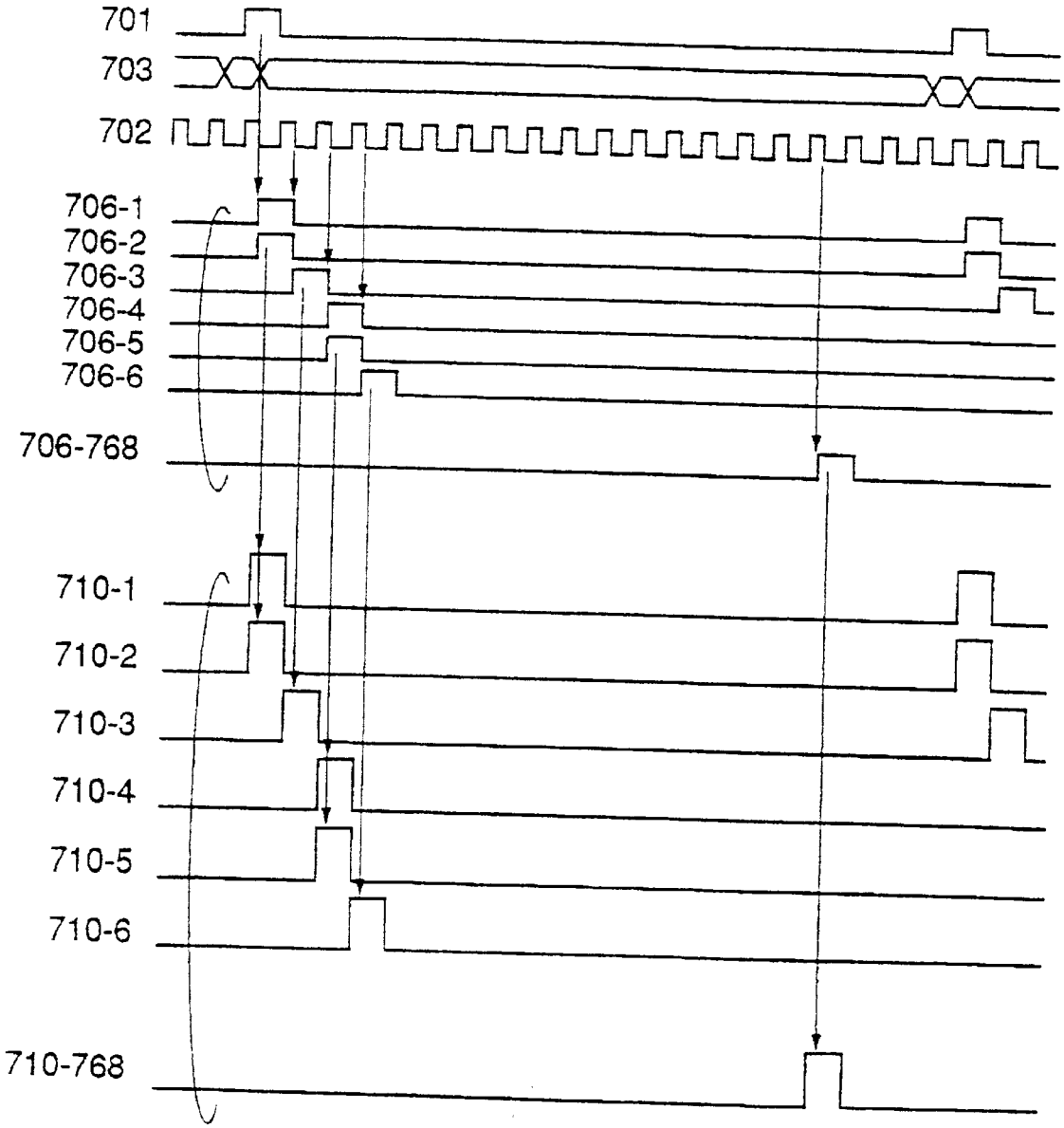
FIG. 8 is a timing chart showing the operation of a scanning driver of the first embodiment.
Figure 9:
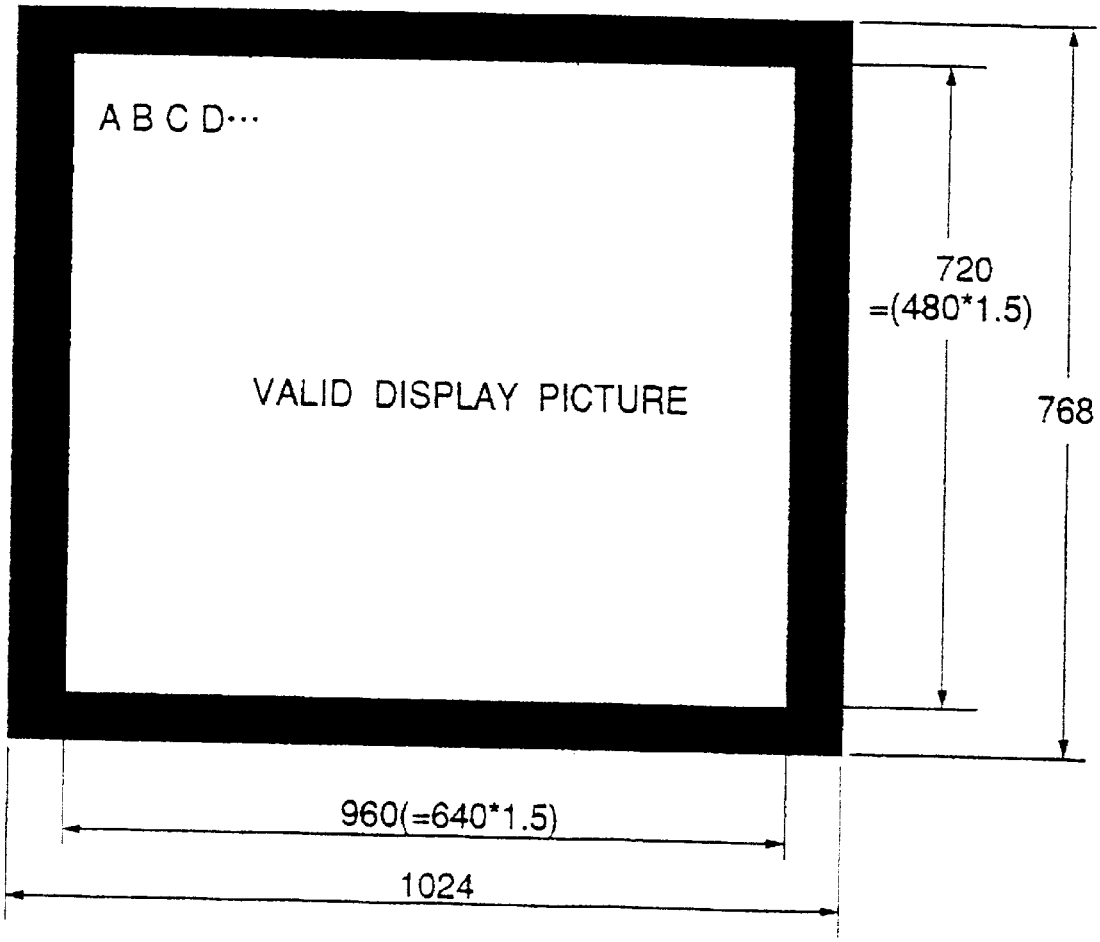
FIG. 9 is a view showing an example display of the first embodiment.
Figure 10A:
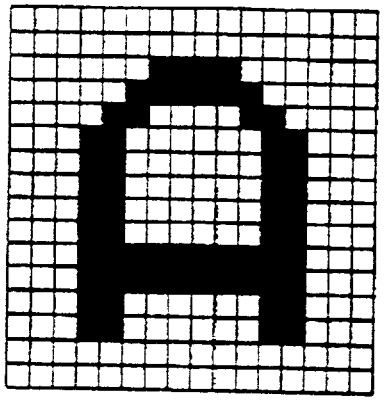
FIG. 10A and FIG. 10B are views showing examples of enlarged displays of the first embodiment.
Figure 10B:
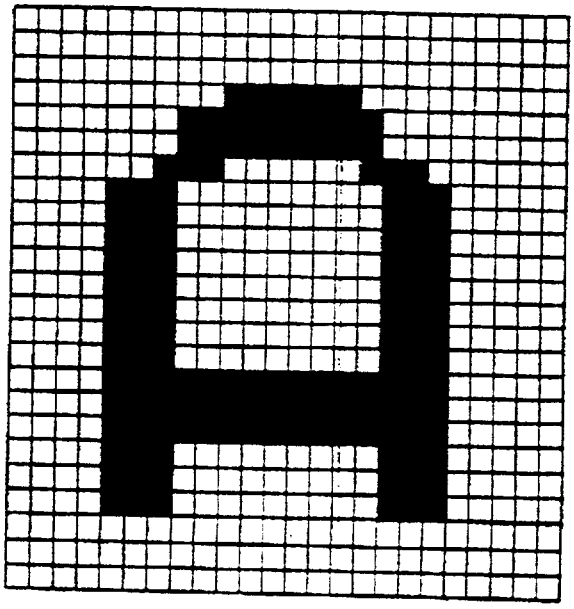

A first embodiment of the present invention will now be described using FIG. 1, FIG. 6, FIG. 7, FIG. 8, FIG. 9, FIG. 10A and FIG. 10B. Here, FIG. 1 is a block diagram of a liquid crystal driver of the present invention, FIG. 6 is a timing chart showing the operation of the liquid crystal driver of the present invention, FIG. 7 is a block diagram of a scanning driver of the present invention, FIG. 8 is a timing chart showing the operation of the scanning driver of the present invention, FIG. 9 is an example display of the present invention and FIG. 10A and FIG. 10B are enlarged example displays of the present invention. The liquid crystal panel 406 of the configuration shown in FIG. 4A is utilized in this first embodiment.

When the resolution of the inputted display data is smaller than the resolution of the liquid crystal panel in this first embodiment, inferior displaying is prevented by enlarging the image in the horizontal direction using the liquid crystal driver and enlarging the image in the vertical direction using the scanning driver. Enlarging in the horizontal and vertical directions is performed by completely separate processes, with these processes being described separately below.

First, the liquid crystal driver and enlargement in the horizontal direction using the liquid crystal driver will be described.

The liquid crystal driver increases the number of items of display data outputted to the liquid crystal panel as a result of the shift register 108 making a plurality of signals for the latch signal group 109 valid simultaneously so as to enlarge the image in the horizontal direction. This is described in detail in the following.

As shown in FIG. 1, this liquid crystal driver comprises a controller 106, shift register 108, data latch 110, line data latch 112 and gradation voltage generator 114, connected together by a data bus for transmitting display data and signal lines etc. In this specification, each of the various signals is referred to using the numerals of the signal lines transmitting these signals. For example, display data transmitted via display data bus 101 is referred to as display data of the display data bus 101.

The controller 106 generates and outputs a control signal 107 for controlling the operation of the shift register 108 based on the display data of the display data bus 101 and the horizontal synchronization signal 104 generated every horizontal period. The controller 106 outputs the control signal 107 to the shift register 108.

The shift register 108 is for generating and outputting the latch signal group 109. This shift register 108 generates the latch signal group 109 based on the control signal 107, clock 102 synchronized with the display data of the display data bus 101 and the display data capture start signal (E1) 103. The shift register 108 of this embodiment can then make the plurality of latch signals of the latch signal group 109 valid simultaneously so that the number of items of display data outputted to the liquid crystal panel is increased, i.e. enlargement in the horizontal direction for displaying is possible when display data of a resolution lower than the resolution of the liquid crystal panel is inputted. The details of the shift register 108 are described in detail later using FIG. 27.

The data latch 110 latches the display data of the display data bus 101 in accordance with the latch signal group 109 and transmits stored display data to the line data latch 112 via the data bus 111. The data latch 110 is equipped, in its inside, with a plurality of latches provided every latch signal 109.

The line data latch 112 latches the display data of the display bus 111 at a timing decided based on the horizontal synchronization signal 104, with this display data of the display bus 111 then being outputted to the gradation voltage generator 114 via the data bus 113.

The gradation voltage generator 114 generates a gradation voltage based on the display data transmitted via the data bus 113. This gradation voltage is then outputted to the liquid crystal display via the signal line group (hereinafter referred to as the "drain line group") 115 410). The reference gradation voltage 105 that is taken as a reference for the gradation voltage is inputted to the gradation voltage generator 114.

The operation of the liquid crystal driver (refer to FIG. 1) will now be described.

Here, it is taken that the resolution of the display data of the display data bus 101 is lower than the resolution of the liquid crystal display panel. Specifically, the resolution of the inputted display data of the display data bus 101 is taken to be 640 horizontal dots by 480 vertical lines and the resolution of the liquid crystal panel is taken to be 1024 horizontal dots by 768 vertical lines.

The controller 106 outputs the control signal 107, with the shift register 108 operating as shown in FIG. 6 in response to this control signal 107. In FIG. 6, when the display data capture start signal 103 becomes valid (a "low" level is taken to be valid in this case), the shift register 108 sequentially puts latch signal groups 109-1 to 109-1024 valid in synchronization with the clock 102. Here, the difference with the operation of related liquid crystal drivers is that a plurality of latch signals of the latch signal group 109 are put to valid simultaneously. Namely, when the clock 102 becomes valid, the shift register 108 first puts latch signal 109-1 and latch signal 109-2 to valid. The latch corresponding to the latch signal 109-1 and the latch corresponding to the latch signal 109-2 within the data latch 110 therefore store the same display data and data bus 111-1 and data bus 111-2 of FIG. 6 therefore output the same display data.

The next time the clock 102 becomes valid, the shift register 108 puts a latch signal 109-3 to valid. Display data transmitted via the display data bus 101 at this time is therefore latched at the latch corresponding to the latch signal 109-3 within the data latch 110. This latched display data is then outputted to the data bus 111-3.

After this, when the clock 102 again becomes valid, the latch signals 1094 and 109-5 both become valid simultaneously in the same way as the case for the latch signals 109-1 and 109-2. The same display data is also stored at the latch corresponding to the latch signal 109-4 and the latch corresponding to the latch signal 109-5 within the data latch 110. The same display data is then also outputted to data busses 111-4 and 111-5.

The shift register 108 and the data latch 110 repeat the above operation during displaying.

The line data latch 112 simultaneously captures one line portion of display data of the display bus 111 and outputs this display data of the display bus 111 to the data bus 113. The gradation voltage generator 114 converts display data of the data bus 113 into gradation voltages and outputs these gradation voltages simultaneously via the drain line group 115.

In this way, inputted one-pixel portions of display data can be expanded to two pixels lined up in the horizontal direction on the liquid crystal panel. In this embodiment, the ratio of the frequency of making two neighboring latch signals of the latch signal group 109 simultaneously become valid and the frequency of making one latch signal of the latch signal group 109 independently become valid is taken to be 1:1 and enlarged displaying of 1.5 times is therefore possible in the horizontal direction. It is possible for the display data capture start position to be controlled using the display data capture start signal 103 described previously.

Figure 27:
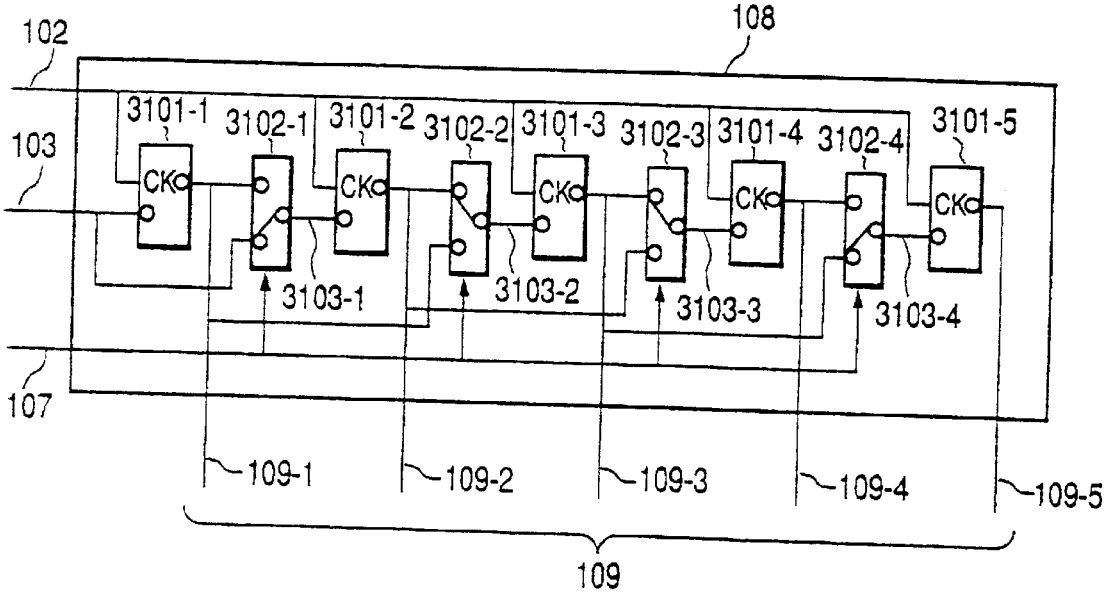
FIG. 27 is a block diagram showing a shift register 108 of the first and second embodiments.

Next, a detailed description is given of the shift register 108 using FIG. 27.

For simplicity, five lines are taken to be outputted as the latch signal group 109. Here, numeral 3101 indicates flip-flops, CK indicates a clock input, D indicates a data input, Q indicates a data output and numeral 3102 indicates selectors. Outputs 3103 of the selectors 3102 are inputted to flip-flops 3101 and outputs of the flip-flops 3101 are the latch signals 109.

The shift register 108 changes selection conditions of a selector 3102 in response to the control signal 107. The selector 3102-1 operates so as to select the display data capture start signal 103. The data inputted to flip-flops 3101-1 and 3101-2 is the display data capture start signal 103 in both cases so that the latch signals 109-1 and 109-2 both become valid on the same timing (refer to FIG. 6).

The selector 3102-2 operates so as to select latch signal 109-2 and latch 109-3 is therefore delayed by one clock pulse (refer to FIG. 6) with respect to latch signal 109-2.

Figure 11:
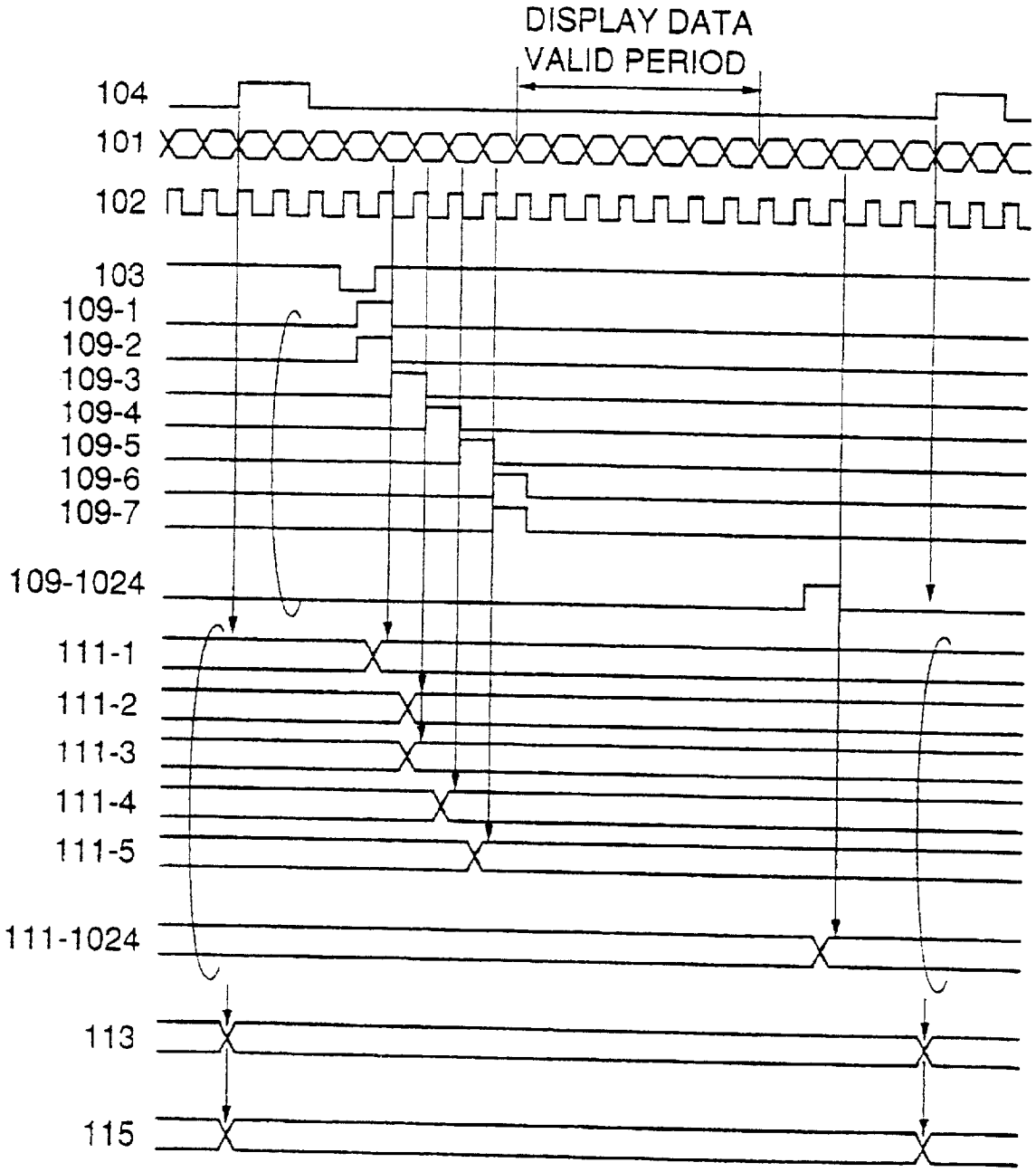
FIG. 11 is a timing chart showing the operation of a liquid crystal driver of a second embodiment of the present invention.

Selector 3102-3 and selector 3102-4 operate so as to select latch signal 109-3. Latch signal 109-4 and latch signal 109-5 therefore become valid together at a timing delayed by one clock from the latch signal 109-3 (refer to FIG. 6). The shift register 108 of this embodiment is therefore capable of making a plurality of latch signals of the latch signal group 109 become valid at one time by controlling the signals selecting each of the selectors 3102. It is then possible to make sequential latch signals of the latch signal group 109 become valid each clock signal as in the related art or further, make neighboring latch signals of the latch signal group 109 become valid simultaneously at a rate of one time each four clocks as shown in FIG. 11.

If the resolution of the display data of the display data bus 101 is the same as the resolution of the liquid crystal panel, the shift register 108 operates the same way as the related example.

Next, a description is given of the scanning driver and enlargement in the vertical direction.

The scanning driver can select the gate line group 710 outputted to the liquid crystal panel to adopt a plurality of states simultaneously because a shift register 705 (refer to FIG. 7) to be described later puts a plurality of the shift clocks of the shift clock group 706 to valid simultaneously. The number of lines of display data can therefore be increased so as to provide enlargement in the vertical direction. The details of this are described in the following.

The scanning driver comprises a shift register 705, level shifter 707 and voltage selector 709, together with each of the various signal lines 701, 702, 703 and 704, and buses 706, 708 and 710 etc.

A line scanning start signal 701, line shift clock 702 and control signal 703 for deciding operation of the shift register 705 are inputted to the shift register 705. The shift register 705 then generates a shift clock group 706 based on these signals. Details of the shift register 705 are described later using FIG. 28.

The level shifter 707 changes voltage levels of the shift clock group 706 and outputs the signals after changing as a shift clock group 708.

The voltage selector 709 selects one of the select or de-select voltages inputted via the power supply line 704 every line based on the shift clock group 708 and outputs a line select or de-select voltage to the liquid crystal panel via the signal line group (hereinafter referred to as the "gate line group") 710.

The operation of the scanning driver is now described using FIG. 8.

The shift register 705 operates in accordance with the control signal 703. When the resolution of the display data inputted via the display data bus 101 of FIG. 1 is lower than the resolution of the liquid crystal panel the shift register 705 operates as follows.

When the line scanning start signal 701 is valid (here, valid is taken to be a "high" level), the shift register 705 makes shift clocks 706-1 to 706-768 valid in that order. The difference in operation with the related scanning driver is that a plurality of shift clocks of the shift clock group 706 are put valid simultaneously.

When the line shift clock 702 first becomes valid from the line scanning start signal 701 becoming valid, the shift register 705 makes the shift clock 706-1 and the shift clock 706-2 valid simultaneously.

The next time the line shift clock 702 is valid, the shift register 705 makes the shift clock 706-3 valid for this time. When the line shift clock 702 then becomes valid after this, the shift register 705 makes shift clock 706-4 and shift clock 706-5 valid simultaneously. The shift register 705 then repeats the above operation every time the line shift clock 702 becomes valid.

The level shifter 707 changes the voltage level of the shift clock group 706 and outputs this to the voltage selector 709 as the shift clock group 708. The voltage selector 709 then outputs a select or de-select voltage to the gate line group 710 in response to the shift clock group 708. Select voltages are then applied simultaneously to gate lines of the gate line group 710 corresponding to shift clocks of the shift clock group 706 that have been simultaneously made valid. As a result, when select voltages are simultaneously applied to two gate lines of the gate line group 710 the horizontal line gradation voltage transmitted at this time via drain lines of the drain 115 is simultaneously applied to two lines.

In this embodiment, the ratio with which the frequency with which two gate lines of the gate line group 710 are made valid and the frequency with which one gate line is independently made valid is taken to be 1:1.

Displaying enlarged by 1.5 times is therefore possible in the vertical direction and the display start line position in the vertical direction is regulated by the line scanning start signal 701 described previously.

Figure 28:
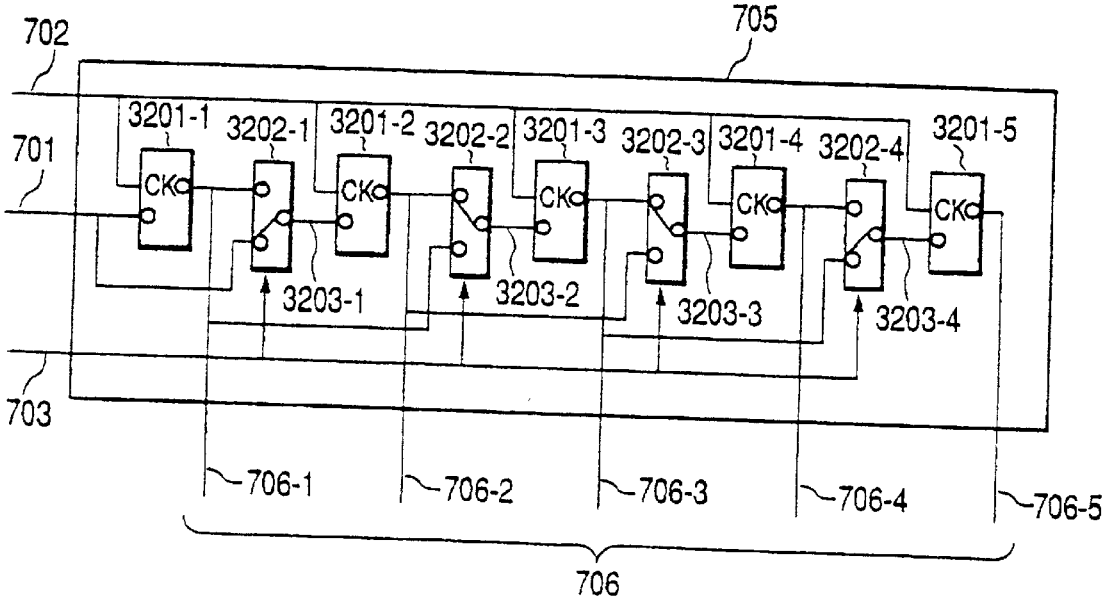
FIG. 28 is a block diagram showing a shift register 705 of the first and second embodiments.

The details of the shift register 705 will now be described using FIG. 28.

For simplicity, the shift clock group 706 is taken to be an output of five latch signals. Numeral 3201 indicates a flip-flop, CK indicates a clock input, D indicates a data input and Q indicates a data output. Numeral 3202 indicates a selector, with an output 3203 of the selector 3202 being inputted to the flip-flop 3201 and the output of the flip-flop 3201 being the gate line group 710.

The operation of the shift register 705 will now be described.

This shift register 705 changes the data selected by the selector 3202 in response to the control signal 703.

The selector 3202-1 operates so as to select the line scanning start signal 701 and the data inputted to the flip-flop 3201-1 and the flip-flop 3202-2 therefore become the display start line scanning start signal 701 in both cases. As a result, the latch signal 706-1 and the latch signal 706-2 become valid on the same timing (refer to FIG. 8).

The selector 3202-2 operates so as to select the latch signal 706-2 and the latch signal 706-3 is therefore delayed by one clock pulse with respect to the latch signal 706-2 (refer to FIG. 8).

The selectors 3202-3 and 3202-4 operate so as to select the latch signal 706-3. Latch signals 706-4 and 706-5 are therefore delayed by one clock pulse from the latch signal 706-3 and become valid together on the same timing (refer to FIG. 8).

Figure 12:
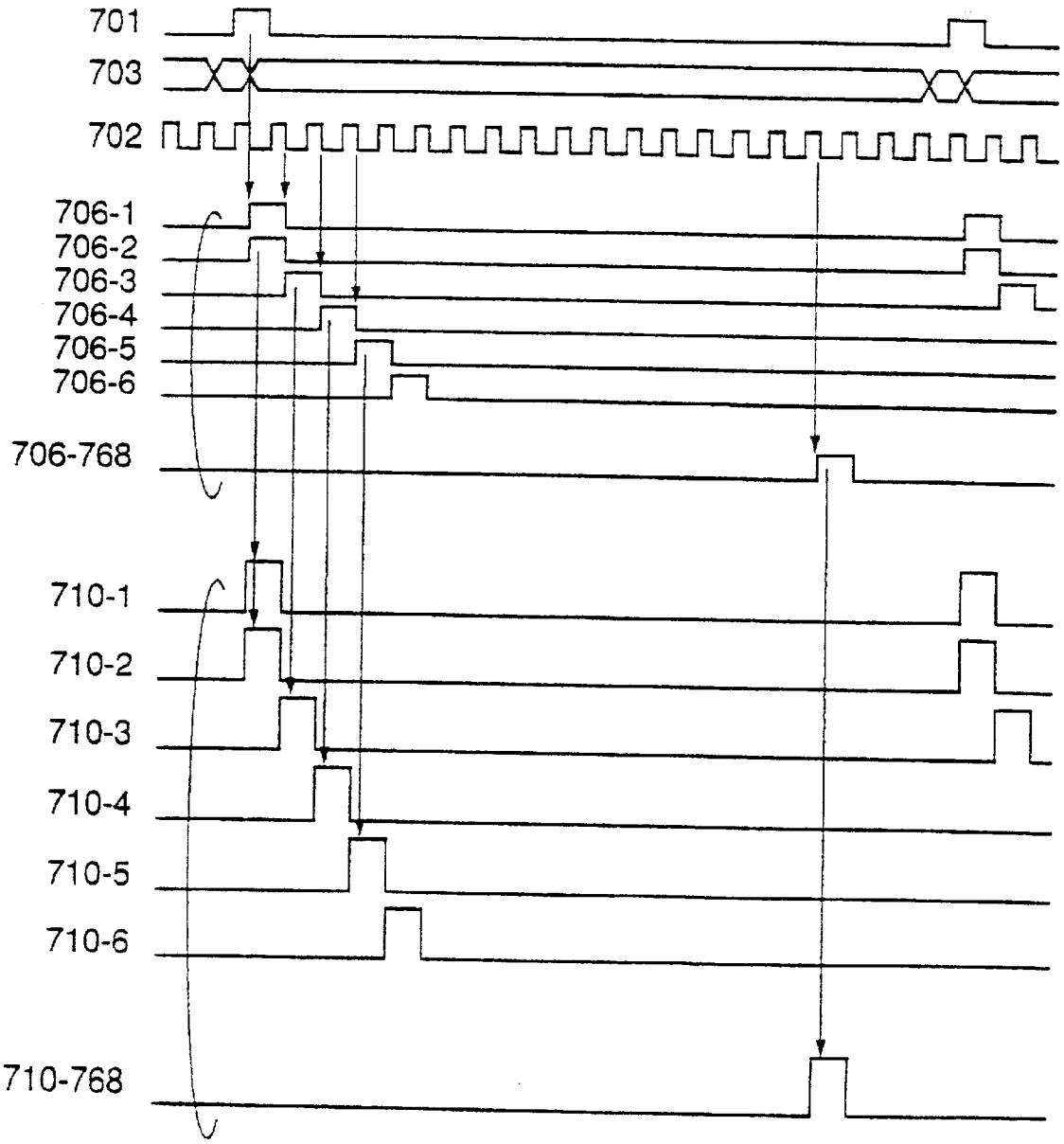
FIG. 12 is a timing chart showing the operation of a scanning driver of the second embodiment.

The shift register 705 of this embodiment is therefore capable of setting a plurality of latch signals of the latch signal group 706 valid simultaneously by controlling the signal selected by the selector 3202. The shift register 705 is therefore capable of sequentially setting latch signals of the latch signal group 706 to valid every one clock as in the related art or simultaneously setting neighboring latch signals of the latch signal group 706 to valid at a ratio of one time every four clocks as shown in FIG. 12.

When the resolution of the liquid crystal panel is the same as the resolution of the display data of the display data bus 101, the shift register 705 operates in the same way as the example of the related art.

An example where display data is processed by the horizontal direction enlargement processing (refer to FIG. 1 and FIG. 6) and the vertical direction enlargement processing (refer to FIG. 7 and FIG. 8) described above used together is shown in FIG. 9, FIG. 10A and FIG. 10B.

Inputted display data of 640 horizontal dots and 480 vertical lines is enlarged to 960 horizontal dots (=640 dots×1.5 times) by the liquid crystal driver (FIG. 1) and 720 vertical lines (=400 lines×1.5) by the scanning driver (FIG. 7).

The resolution of the liquid crystal panel is taken to be 1024 horizontal dots and 768 vertical lines. The display data is therefore insufficient even after enlarging. This can, however, be dealt with by adjusting the displaying position on the display screen, i.e. unnaturalness can be prevented by displaying the image at the approximate center of the liquid crystal panel. The display position in the horizontal direction can be adjusted by setting the display data capture start signal 103 to be valid within the horizontal flyback period. The display position in the vertical direction can be adjusted by setting the line scanning start signal 701 to be valid within the vertical flyback period.

Display regions with no display data are used for displaying horizontal flyback period and vertical flyback period display data (usually black display data).

The original display data before enlargement is shown in FIG. 10A and the display data after enlargement is shown in FIG. 10B. FIG. 10A and FIG. 10B show an example of display data for a 16 dot by 16 line font referred to as "A" that is enlarged. According to this embodiment, font data of 24 dots×24 lines is enlarged.

According to the first embodiment described above, arbitrary enlargement displaying is possible.

Second Embodiment

A second embodiment of the present invention will now be described using FIG. 11, FIG. 12, FIG. 13, FIG. 14A and FIG. 14B together with FIG. 1 and FIG. 7 used in the first embodiment.

Figure 13:
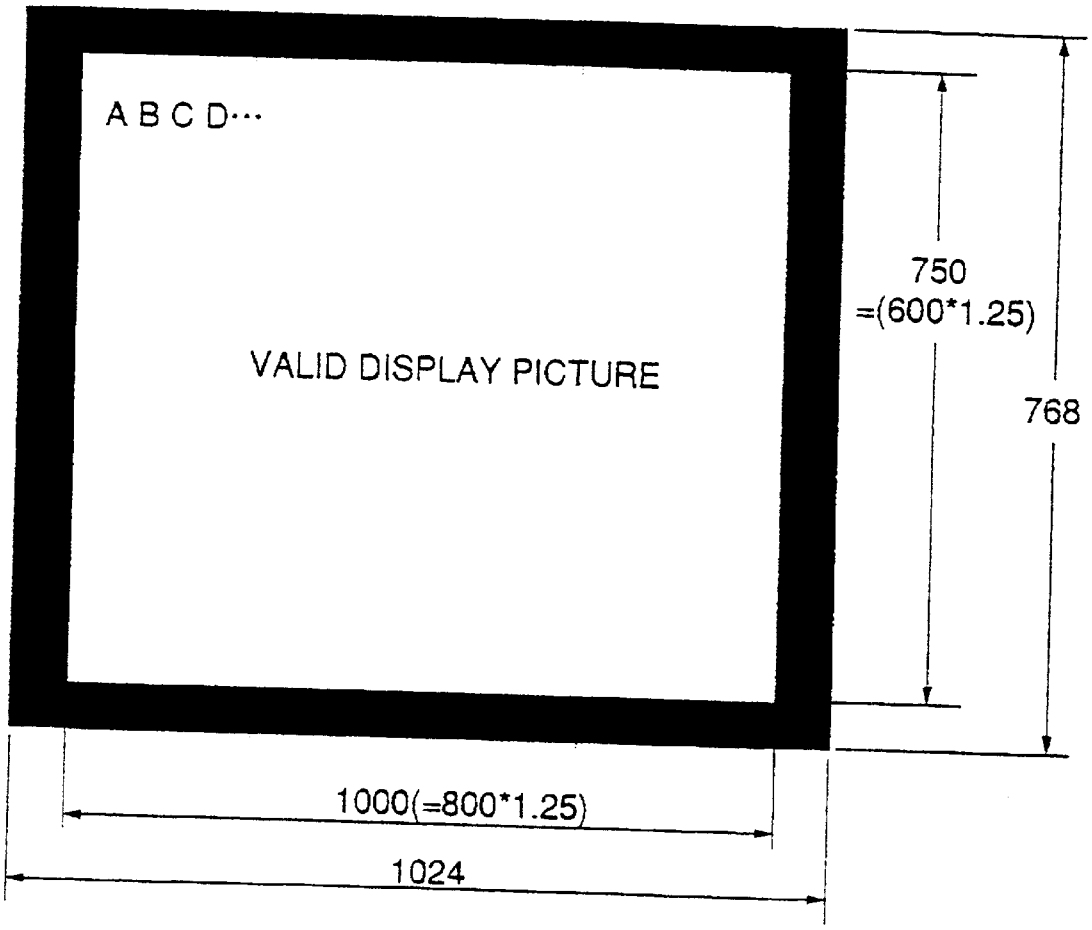
FIG. 13 is a view showing an example display of the second embodiment.
Figure 14A:
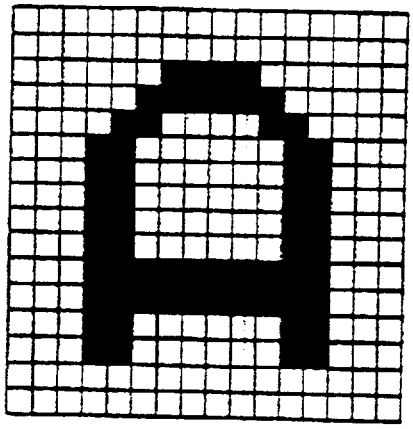
FIG. 14A and FIG. 14B are views showing examples of enlarged displays of the second embodiment.
Figure 14B:
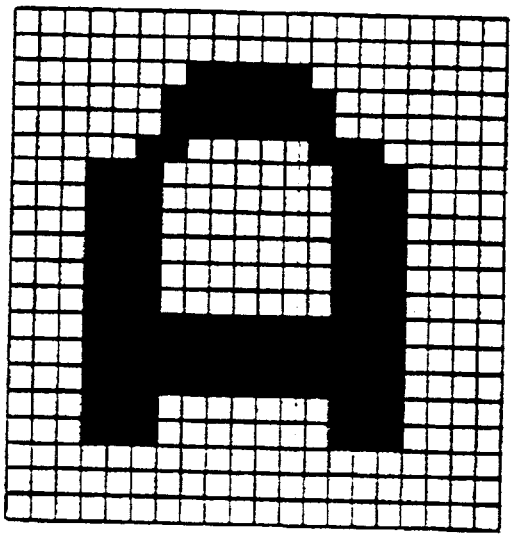

FIG. 11 is a timing chart showing the operation of the liquid crystal driver of the present invention, FIG. 12 is a timing chart of the operation of the scanning driver of the present invention, FIG. 13 is an example display of the present invention and FIG. 14A and FIG. 14B are example displays showing enlargements of the example displays of the present invention.

The second embodiment is an example of enlargement of 1.25 times in the horizontal and vertical directions. Here, the method of enlargement itself is the same as for the first embodiment but the ratio of selecting a plurality of latch signal lines is different, corresponding to a difference in the enlargement rate. In this embodiment, the ratio of the frequency of simultaneously selecting two neighboring latch signal lines of the latch signal group 109 and the frequency of selecting one latch signal line is set to be 1:3, so as to correspond to an enlargement rate of 1.25 times.

The operation of the liquid crystal driver, i.e. the enlargement in the horizontal direction, is described using FIG. 1 and FIG. 11.

The case is described here where the resolution of the display data of the display data bus 101 is lower than the resolution of the liquid crystal panel. Specifically, the resolution of the display data of the display data bus 101 is taken to be 800 horizontal dots and 600 vertical lines and the resolution of the liquid crystal panel is taken to be 1024 horizontal dots and 768 vertical lines.

The controller 106 outputs the control signal 107 for controlling the operation of the shift register 108. The shift register 108 then receives the control signal 107 and operates as shown in FIG. 11. In FIG. 11, when the display data capture start signal 103 becomes valid (here, a "low" level is taken to be valid), the shift register 108 sequentially sets the latch signals 109-1 to 109-1024 of the latch signal group 109 to be valid in synchronization with the clock 102. Here, the shift register 108 operates so as to set the plurality of latch signals of the latch signal group 109 to valid simultaneously, as in the first embodiment. The distinction with the first embodiment, however, is that the ratio of the frequency of simultaneously setting two latch signals of the latch signal group 109 and the frequency of setting one independently selected latch signal of the latch signal group 109 is 1:3.

When the clock 102 first becomes valid after the display data capture start signal 103 becomes valid, the shift register 108 first simultaneously sets the latch signals 109-1 and 109-2 to valid, and the same display data is therefore stored at the latch corresponding to the latch signal 109-1 and the latch corresponding to the latch signal 109-2 within the data latch 110. As a result, the same display data is transmitted to the data buses 111-1 and 111-2 of FIG. 11.

The next time the clock 102 becomes valid, the shift register 108 sequentially sets latch signals 109-3, 109-4 and 109-5 to valid one at a time. As a result the display data transmitted using the display data bus 101 is sequentially latched at each of the latches corresponding to the latch signals 109-3, 109-4 and 109-5 within the data latch 110. This latched display data is then outputted to the data buses 111-3, 111-4 and 111-5.

After this, when the clock 102 again becomes valid, the shift register 108 simultaneously sets the latch signals 109-6 and 109-7 to valid in the same way as the case for the latch signals 109-1 and 109-2. The same display data is therefore stored at both a latch corresponding to the latch signal 109-6 within the data latch 110 and the latch corresponding to the latch signal 109-7, and the same display data is then transmitted to the data buses 111-6 and 111-7.

The shift register 108 and the data latch 110 sequentially repeat the above operation during displaying.

The line data latch 112 simultaneously captures one horizontal line portion of display data of the display bus 111 and outputs this display data of the display bus 111 to the data bus 113. The gradation voltage generator 114 then captures the display data of the display bus 113 and converts this data to a gradation voltage. The gradation voltage is then simultaneously outputted from the drain line group 115.

Next, the operation of the scanning driver, i.e. the enlargement in the vertical direction, is described using FIG. 7 and FIG. 12. A description is given here where the resolution of the display data of the display data bus 101 is lower than the resolution of the liquid crystal panel.

The shift register 705 operates as follows in accordance with the control signal 703. When the line scanning start signal 701 becomes valid (here, valid is taken to be a "high" level), the shift register 705 sequentially sets shift clocks 706-1 to 706-768 of the shift clock group 706 to valid. Here, the shift register 705 setting the plurality of shift clocks of the shift clock group 706 to valid simultaneously is the same as the case for the first embodiment. However, having the ratio of the frequency of simultaneously selecting two neighboring shift clocks of the shift clock group 706 and the frequency of selecting one shift clock of the shift clock group 706 independently set to be 1:3 differs from the first embodiment (in the first embodiment this was 1:1). When the clock 102 first becomes valid after the line scanning start signal 701 has become valid, the shift register 705 simultaneously sets the shift clocks 706-1 and 706-2 to valid. The shift register 705 then sequentially sets the shift clocks 706-3, 706-4 and 706-5 to valid each time the line shift clock 702 becomes valid. After this, when the line shift clock 702 becomes valid, the shift register 705 simultaneously sets the shift clocks 706-6 and 706-7 to valid. The shift register 705 then repeats the above operation during displaying every time the line shift clock 702 becomes valid.

The level shifter 707 changes the voltage level of the shift clock group 706, and outputs this voltage level to the voltage selector 709 via the shift clock group 708. The voltage selector 709 then outputs a select or de-select voltage to the gate line group 710 in response to the shift clock group 708.

An example of display data processed using both the horizontal direction enlarging process (FIG. 11) and the vertical direction enlarging process (FIG. 12) occurring in the second embodiment is shown in FIG. 13, FIG. 14A and FIG. 14B.

Input horizontal data of 800 horizontal dots and 600 vertical lines is enlarged to 1000 horizontal dots (=800 dots×1.25 times) by the liquid crystal driver (FIG. 1) and to 750 vertical lines (=600×1.25 times) by the scanning driver (FIG. 7).

In this embodiment, the resolution of the liquid crystal panel is taken to be 1024 horizontal dots by 768 vertical lines. The display data is therefore insufficient even after enlargement, but this can be dealt with by controlling the position at which the image is displayed. The displaying position in the horizontal direction can also be adjusted by setting the display data capture start signal 103 to be valid within the horizontal flyback period, and the displaying position in the vertical direction can be adjusted by setting the line scanning start signal 701 to be valid within the vertical flyback period, as in the first embodiment.

FIG. 14A shows the original display data before enlarged displaying and FIG. 14B shows the display data after enlargement. An example of the enlargement of display data for a 16 dot×16 line font referred to as "A" is shown in FIG. 14A and FIG. 14B. According to this embodiment, the line font data is enlarged to 20 dot×20 lines.

If the resolution of the display data of the display data bus 101 is the same as the resolution of the liquid crystal panel, the shift registers 108 and 705 operate in the same way as in the related art.

According to the first and second embodiments, displaying by enlarging by an arbitrary number of times is possible. The enlargement processing employing the above method can be applied to color displaying without modification.

The enlargement processing occurring in the above first and second embodiments simply enlarges one pixel portion of display data for prescribed pixels into two pixel portions. There is, however, another method of enlarging where weightings are given to data for neighboring pixels and interpolated pixels are made. An example carrying out enlargement processing using this kind of method is described in subsequent third and fourth embodiments.

Third Embodiment

A third embodiment will now be described using FIG. 15, FIG. 16, FIG. 17, FIG. 18, FIG. 19, FIG. 20A and FIG. 20B.

The enlargement processing occurring in the third embodiment is a method where a weighting is given to data for neighboring pixels and interpolated pixels are made.

Figure 15:
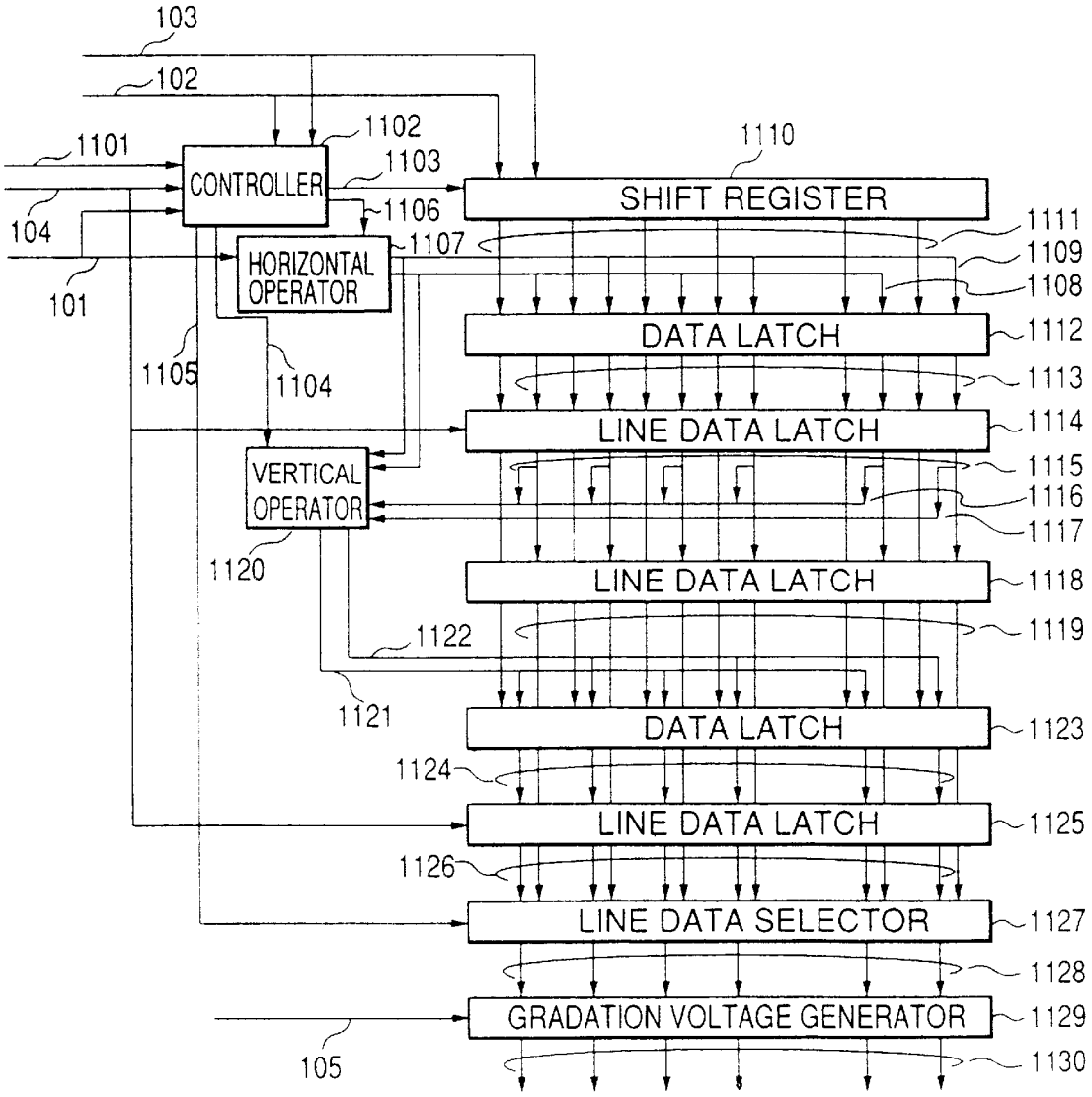
FIG. 15 is a block diagram of a liquid crystal driver of a third embodiment of the present invention.
Figure 16:
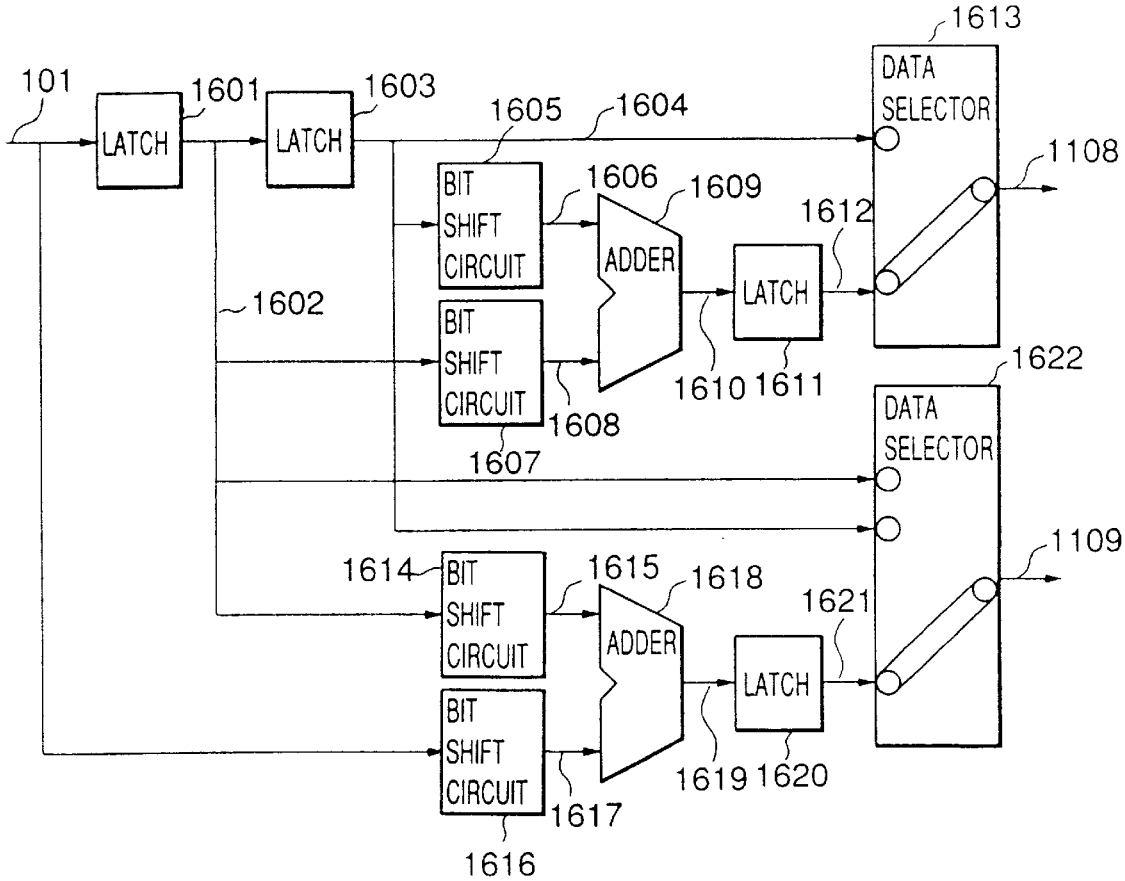
FIG. 16 is a block diagram of a horizontal operator.
Figure 17:
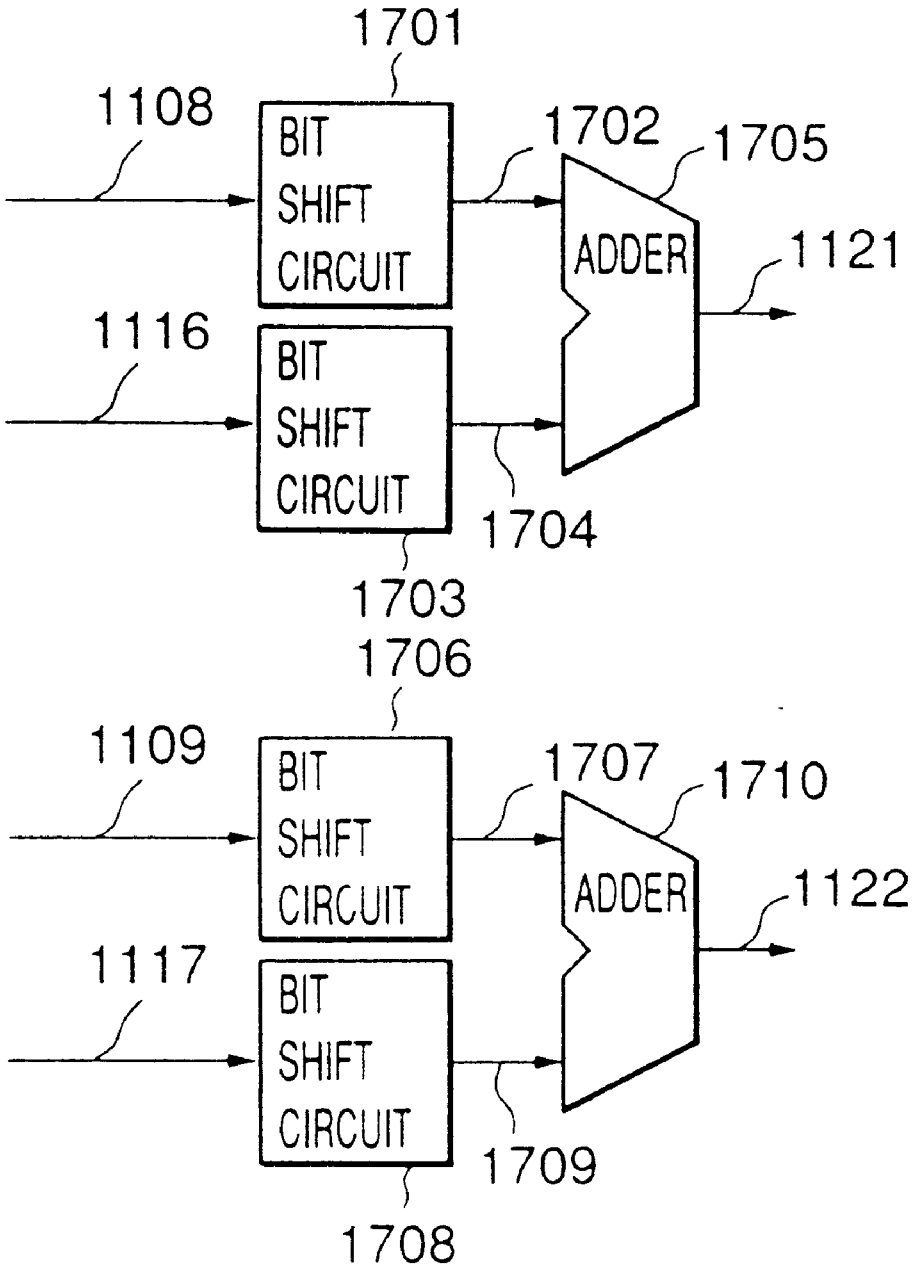
FIG. 17 is a block diagram of a vertical operator.
Figure 18:
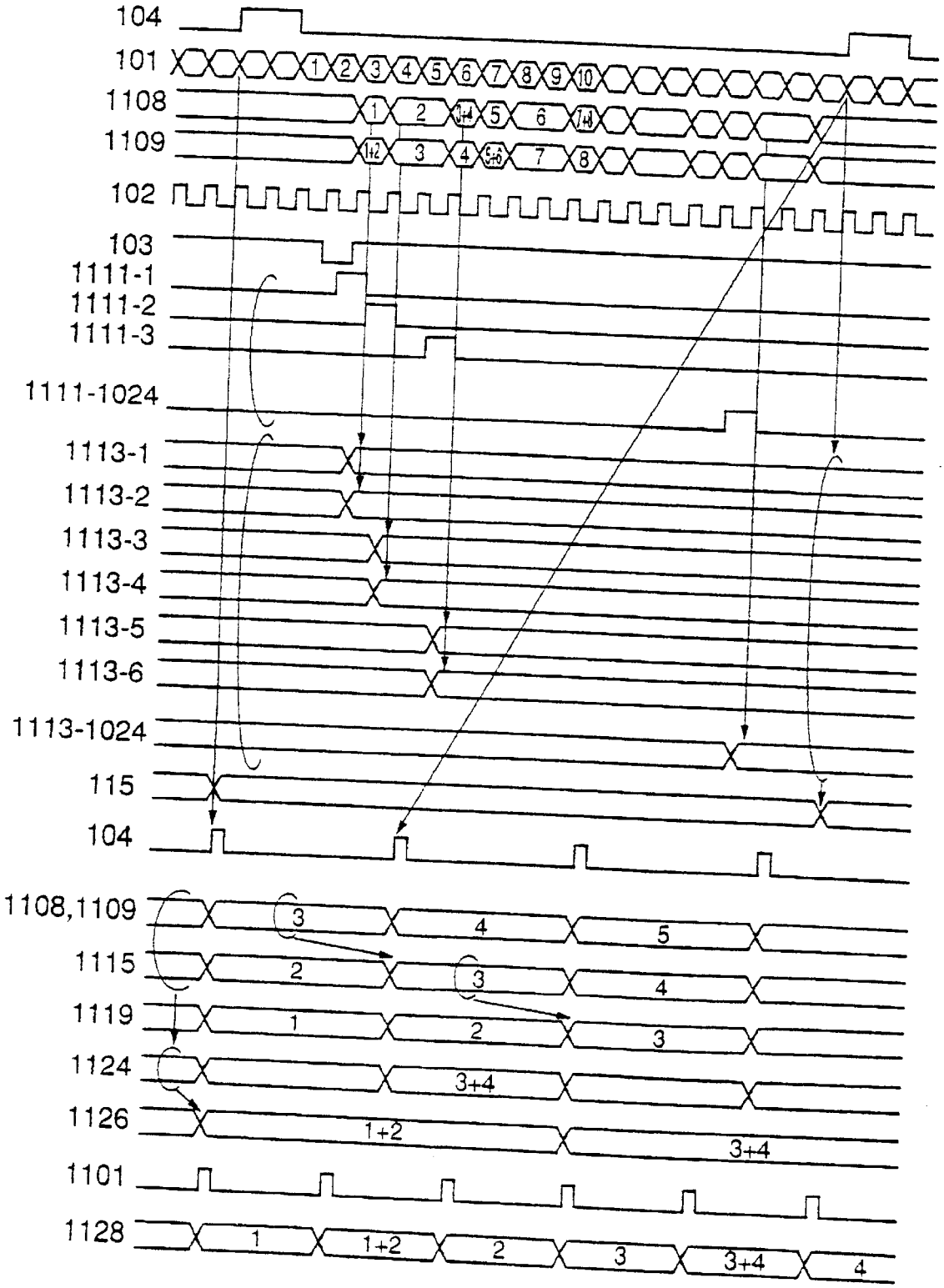
FIG. 18 is a timing chart showing the operation of a liquid crystal driver of the third embodiment.
Figure 19:
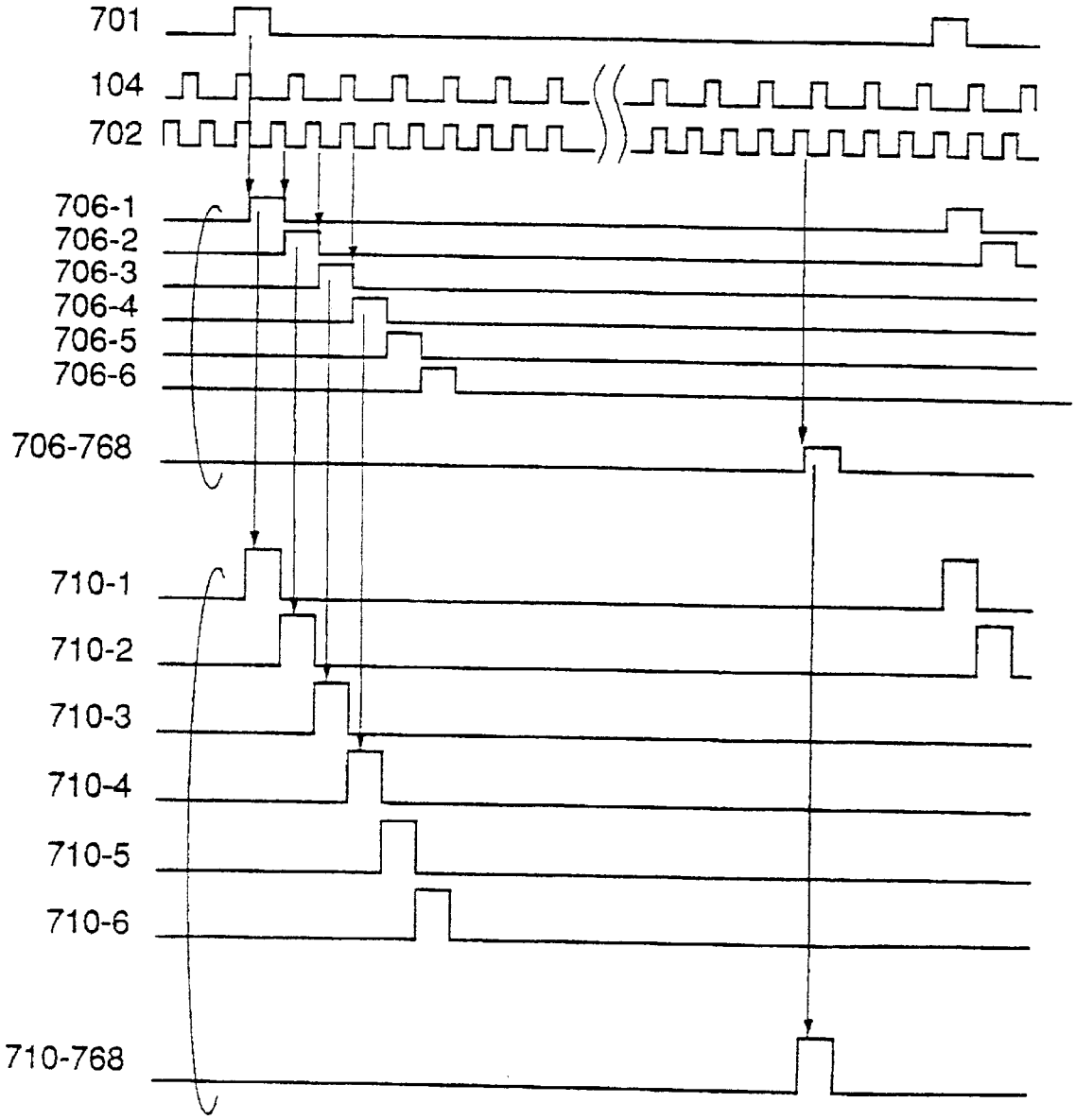
FIG. 19 is a timing chart showing the operation of a scanning driver of the third embodiment.
Figure 20A:
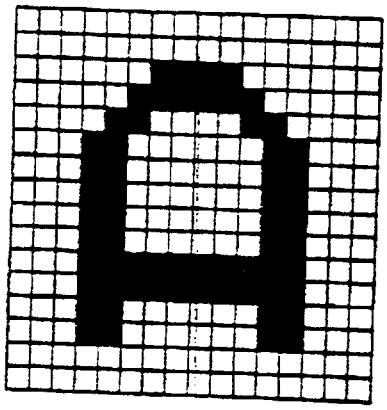
FIG. 20A and FIG. 20B are views showing examples of enlarged displays of the third embodiment.
Figure 20B:
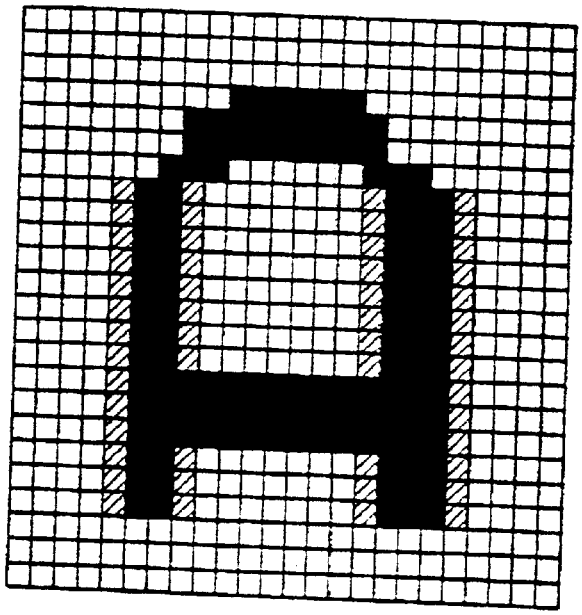

FIG. 15 is a block diagram of a liquid crystal driver of the present invention, FIG. 16 is a block diagram of a horizontal operator of the liquid crystal driver of the present invention, FIG. 17 is a block diagram of the vertical operator for the liquid crystal driver of the present invention, FIG. 18 is a timing chart showing the operation of the liquid crystal driver of the present invention, FIG. 19 is a timing chart showing the operation of the scanning driver of the present invention, and FIG. 20A and FIG. 20B are example displays expanded from example displays of the present invention. The liquid crystal panel 406 of the configuration shown in FIG. 4A is utilized in this embodiment.

Here, the resolution of the inputted display data is 640 horizontal dots by 480 vertical lines, with this being enlarged 1.5 times for displaying on a liquid crystal panel of a resolution of 1024 horizontal dots by 768 vertical lines.

As shown in FIG. 15, the liquid crystal driver of this third embodiment comprises a controller 1102, horizontal operator 1107, shift register 1110, data latch 1112, line data latch 1114, line data latch 1118, vertical operator 1120, data latch 1123, line data latch 1125, line data selector 1127 and a gradation voltage generator 1129, together with the various signal lines and data busses connecting these items.

The controller 1102 generates and outputs a control signal 1103, operation control signal 1104, output select signal 1105 and operation control signal 1106 for controlling other operations of the shift register 1110. An output control signal 1101, the display data of the display data bus 101, clock 102, display data capture start signal 103 and horizontal synchronization signal 104 are inputted to the controller 1102, with each of the control signals being generated based on these signals. The output control signal 1101 is used to control the timing of the output of the gradation voltage. The control signal 1103 is for controlling the timing of the operation of the shift register 1110. The operation control signal 1104 is for controlling vertical operations and is outputted to the vertical operator 1120. The output select signal 1105 is for selecting the gradation voltage to be outputted and is outputted to the line data selector 1127. The operation control signal 1106 is for controlling horizontal operations and is outputted to the horizontal operator 1107. The specific circuit configuration etc. of the controller 1102 is described later using FIG. 29.

The horizontal operator 1107 is for carrying out enlargement processing in the horizontal direction and is configured in such a manner as to separately output odd-numbered pixel data of the display data after enlargement processing via an odd pixel data bus 1108 and output even-numbered pixel data via an even pixel data bus 1109. Odd-numbered pixel data is display data outputted for pixels that are odd-numbered from the left side (hereinafter referred to as "odd pixels") of the liquid crystal panel. Even numbered pixel data is display data outputted for pixels that are even-numbered (hereinafter referred to as "even pixels") from the left side of the liquid crystal panel. The details of the horizontal operator 1107 are described later using FIG. 16.

The vertical operator 1120 generates display data to be newly added during enlargement in the vertical direction using interpolation and is configured so as to output display data generated by interpolation to the data latch 1123 via an odd pixel data bus 1121 and an even pixel data bus 1122. The details of the vertical operator 1120 are described later using FIG. 17.

The line data selector 1127 selects one of either display data of the data bus 1119 or display data of the data bus 1126 in accordance with the output select signal 1105 generated at the controller 1102. The line data selector 1127 then transmits the selected display data to the gradation voltage generator 1129 via the data bus 1128.

The operation of the whole of the liquid crystal driver (FIG. 15) will now be described with reference to FIG. 18.

The coefficient for calculating the display data appearing on the data bus is not described in this embodiment for ease of description.

The controller 1102 generates each of the control signals 1103, 1104, 1105 and 1106 and outputs these signals to each of the respective parts which operate according to these control signals.

The horizontal operator 1107 performs enlargement processing in the horizontal direction on the inputted display data in accordance with the control signal 1106. Odd pixel data of the display data after enlargement processing is then outputted to the data latch 1112 via the odd pixel data bus 1108 and even pixel data is outputted to the data latch 1112 via the even pixel data bus 1109. The details of the enlargement processing in the horizontal direction are described later using FIG. 16.

The shift register 1110 outputs a latch signal group 1111 to the data latch 1112 in accordance with the control signal 1103.

The data latch 1112 latches the odd-numbered pixel data of the odd pixel data bus 1108 and even-numbered pixel data of the even pixel data bus 1109 in accordance with the latch signal group 1111. When one horizontal line portion of display data is stored in the data latch 1112, the line data latch 1114 simultaneously stores display data inputted via the data bus 1113, before transmitting the stored display data to the line data latch 1118 via the data bus 1115. The same display data is also transmitted to the vertical operator 1120 via the odd pixel data bus 1116 and the even pixel data bus 1117.

The vertical operator 1120 generates interpolated pixels for the vertical direction based on the inputted display data and transmits display data for these interpolated pixels to the data latch 1123 via the data buses 1121 and 1122 (refer to FIG. 18).

The data latch 1123 sequentially latches display data in response to the latch signal group 1111 generated by the shift register 1110. When one horizontal line portion of display data is stored at the data latch 1123, the line data latch 1125 simultaneously stores display data sent from the data latch 1123 via the data bus 1124. The stored display data is then transmitted to the line data selector 1127 via the data bus 1126.

Display data stored at the line data latch 1118 is also transmitted to the line data selector 1127 via the data bus 1119. The line data selector 1127 then selects one of either the display data of the data bus 1119 or the display data of the data bus 1126 in accordance with the output select signal 1105 and transmits the selected data to the gradation voltage generator 1129 via the data bus 1128.

The gradation voltage generator 1129 generates gradation voltages based on the display data transmitted via the data bus 1128. The generated gradation voltages are then outputted to the liquid crystal panel via the signal line group (hereinafter referred to as the drain group) 1130.

A description of the operation of the line data selector 1127 will now be given using FIG. 18.

The line data selector 1127 exerts control in such a manner as to divide the output period into three within two horizontal input periods. The line data selector 1127 first selects the display data appearing on the data bus 1119. The display data appearing on the data bus 1126 that has undergone arithmetic processing operations is then selected. Finally, the display data appearing on the data bus 1119 is selected. The line data selector 1127 then transmits the selected display data to the gradation voltage generator 1129 via the data bus 1128.

Interpolation pixels are generated for the horizontal and vertical directions and the liquid crystal driver can perform enlargement processing as a result of the above-mentioned series of operations.

Next, the details of the horizontal operator 1107 are described using FIG. 16.

The horizontal operator 1107 comprises latches 1601, 1603, 1611 and 1620, bit shift circuits 1605, 1607, 1614 and 1616, adders 1609 and 1618, and data selectors 1613 and 1622, together with each of the various signal lines and buses etc. connecting these items together.

The bit shift circuits 1605, 1607, 1614 and 1616 are one bit shift circuits for halving the display data inputted via the data bus.

Odd pixel data generation processing and even pixel data generation processing is carried out in parallel within the horizontal operator 1107.

First, a description is given of the generation processing for odd pixel data.

The latch 1601 latches display data inputted via the display data bus 101 and transmits the latched display data to the latch 1603 and the bit shift circuit 1607 via the data bus 1602. Further, the latch 1603 transmits the latched display data to the bit shift circuit 1605 via the data bus 1604. The bit shift circuits 1605 and 1607 output the display data to the adder 1609 together after bit shifting. The adder 1609 then adds the display data inputted from the bit shift circuit 1605 and the display data inputted from the bit shift circuit 1607.

In this case, there is a phase difference of one clock portion between the display data inputted from the latch 1601 directly to the bit shift circuit 1607 via the data bus 1602 and display data inputted to the bit shift circuit 1605 via the latch 1603 and the data bus 1604. Therefore, when the display data inputted to the bit shift circuit 1605 is taken to be X(n) and the display data inputted to the bit shift circuit 1607 is taken to be X(n+1), the display data generated as a result of operations of the adder 1609 becomes $\frac{1}{2}\cdot X(n)+\frac{1}{2}\cdot X(n+1)$. Namely, the adder 1609 display data is generated where processing is carried out giving a weighting of ½ to pairs of pixels neighboring each other in the horizontal direction.

The latch 1611 temporarily stores the display data 1610 outputted by the adder 1609 and transmits this display data 1610 to the data selector 1613 via a data bus 1612.

The latch 1603 also outputs the latched display data to the data selector 1613 via the data bus 1604.

The data selector 1613 selects either one of the display data of the data bus 1604 or the display data of the data bus 1612 in accordance with the control signal 1106 inputted from the controller 1102 (refer to FIG. 15) and outputs the selected display data via the odd pixel data bus 1108.

The actual conditions for outputting the display data at the odd pixel data bus 1108 are shown in FIG. 18. The numbers given to the signals in FIG. 18 show the order of inputting via the display data bus 101. For example, display data "2" is inputted after display data "1" and display data "3+4" is interpolation pixel display data generated based on display data "3" and display data "4". Further, display data "1" appearing on the odd pixel data bus 1108 is display data sourced via the data bus 1604, display data "2" is display data sourced via the data bus 1604 and display data "3+4" is display data sourced via the data bus 1612.

The following is a description of the even number pixel data generating process.

The latch 1601 also transmits latched display data to the bit shift circuit 1614 via the data bus 1602.

Further, display data transmitted via the display data bus 101 is also inputted directly to the bit shift circuit 1616.

The bit shift circuits 1614 and 1616 output the inputted display data to the adder 1618 after bit shifting. The adder 1618 then adds the display data inputted from the bit shift circuit 1614 and the display data inputted from the bit shift circuit 1616.

In this case, there is a phase difference of one clock pulse between display data inputted to the bit shift circuit 1614 from the latch 1601 via the data bus 1602 and display data inputted directly to the bit shift circuit 1616 via the display data bus 101.

Therefore, when the display data inputted to the bit shift circuit 1614 is taken to be X(m) and the display data inputted at the bit shift circuit 1616 is taken to be X(m+1), the display data generated as a result of operations of the adder 1618 becomes $\frac{1}{2}\cdot X(m)+\frac{1}{2}\cdot X(m+1)$. Namely, the adder 1618 generates display data by carrying out processing giving a weighting of ½ to pairs of pixels neighboring each other in the horizontal direction.

The latch 1620 then temporarily stores display data 1619 outputted by the adder 1618 and transmits this display data to the data selector 1622 via the data bus 1621.

The latch 1601 also transmits latched display data to the data selector 1622 via the data bus 1602 and the latch 1603 transmits latched display data to the data selector 1622 via the data bus 1604.

The data selector 1622 selects one of the display data inputted via the data bus 1604, the display data inputted via the data bus 1602 and the display data inputted via the data bus 1621 for outputting via the even pixel data bus 1109 in accordance with the operation control signal 1106.

The conditions for actually outputting display data at the even pixel data bus 1109 are shown in FIG. 18. The display data "1+2" is display data sourced from the data bus 1621, the display data "4" is display data sourced from the data bus 1604, the display data "3+4" is display data sourced from the data bus 1602.

A control signal 1103 for controlling the operation of the shift register 1110 is outputted in response to display data outputted by the odd and even pixel data buses 1108 and 1109 in this order and at this timing. The shift register 1110 outputs the latch signal group 1111 in accordance with the control signal 1103, with the conditions for this latch signal group 1111 being shown in FIG. 18. The data latch 1112 also stores the display data of the odd and even pixel data buses 1108 and 1109 in order in accordance with the latch signal group 1111, with the conditions for the operation of the data latch 1112 being listed in the timing chart for the data bus 1113 in FIG. 18.

Next, the details of the vertical operator 1120 are described using FIG. 17.

The vertical operator 1120 comprises bit shift circuits 1701, 1703, 1706 and 1708 and adders 1705 and 1710, together with signal lines and data buses connecting these bit shift circuits and adders together.

The bit shift circuit 1701, 1703, 1706 and 1708 are one bit shift registers for dividing inputted display data in half.

The operation of the vertical operator 1120 will now be described using FIG. 17.

Display data is inputted to the vertical operator 1120 via the odd and even pixel data buses 1116 and 1117 with display data also being inputted directly to the vertical operator 1120 from the horizontal operator 1107 via the odd and even pixel data buses 1108 and 1109.

Of the above configuration elements, odd pixel data generation is carried out by the bit shift circuits 1701 and 1703 and the adder 1705.

The bit shift circuit 1701 subjects display data inputted via the odd pixel data bus 1108 to one bit bit-shift processing so as to halve this display data.

The bit shift circuit 1701 then outputs the generated display data to the adder 1705 via the data bus 1702. On the other hand, the bit shift circuit 1703 subjects the display data inputted via the odd pixel data bus 1116 to one bit bit-shift processing so as to give half the display data. The bit shift circuit 1703 then outputs the generated display data to the adder 1705 via the data bus 1704.

In this case, display data inputted via the odd and even pixel data buses 1116 and 1117 has passed through the line data latch 1114 one time and is therefore delayed by one horizontal line portion with respect to the directly inputted display data inputted from the horizontal operator 1107 via the odd and even pixel data buses 1108 and 1109 (refer to FIG. 18). When the display data inputted to the bit shift circuit 1701 is taken to be Y(n) and the display data inputted to the bit shift circuit 1703 is taken to be Y(n+1), the display data of the data bus 1121 outputted by the adder 1705 becomes $\frac{1}{2}\cdot Y(n)+\frac{1}{2}\cdot Y(n+1)$, i.e. display data where processing is carried out giving a weighting of ½ to neighboring pixels is generated. Display data generated by the adder 1705 is outputted via the data bus 1121.

On the other hand, generation of even pixel data is carried out by the bit shift circuits 1706 and 1708, and the adder 1710. The display data transmitted via the even pixel data bus 1109 and the display data sent via the even pixel data bus 1117 are subjected to the same processing by the above circuitry, with resulting data being outputted via the even pixel data bus 1122.

Figure 29:
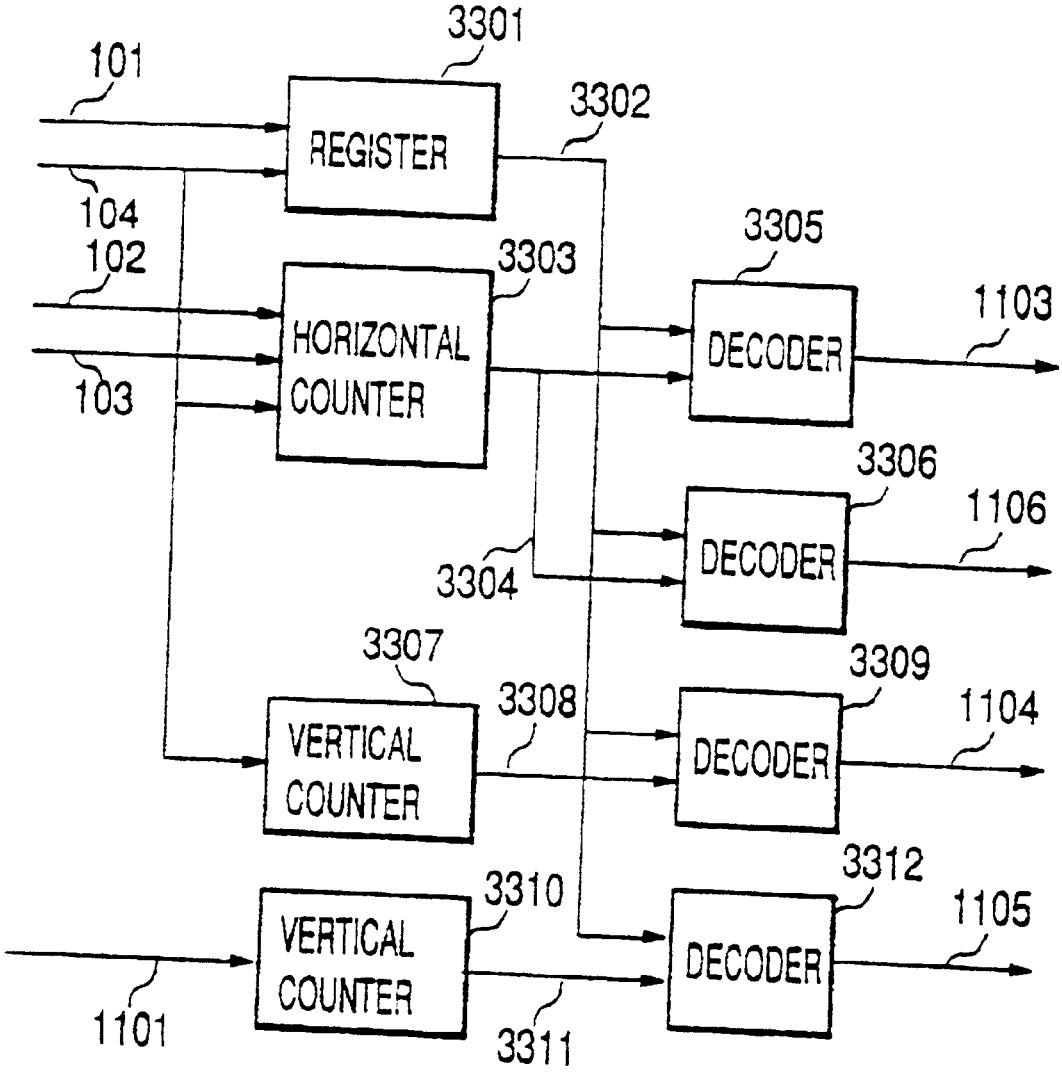
FIG. 29 is a block diagram showing a controller 1102 of the third embodiment.

The details of the controller 1102 will now be described using FIG. 29.

The controller 1102 comprises a register 3301, horizontal counter 3303, decoders 3305 and 3306, vertical counter 3307, decoder 3309, vertical counter 3310 and decoder 3312.

The register 3301 stores data for control use transmitted via the display data bus 101. This data for control use can be transferred during the flyback period when display data is not being transmitted.

The data for control use stored in the register 3301 is transmitted to decoders 3305, 3306, 3309 and 3312 via the data bus for control use 3302.

The counter 3303 operates in response to the display data capture start signal 103 and the horizontal synchronization signal 104 and outputs a count value to decoders 3305 and 3306 as the output signal 3304. The decoder 3305 then generates a control signal 1103 based on these output signals 3304. The decoder 3306 generates the control signal 1106.

The vertical counter 3307 operates in response to the horizontal synchronization signal 104 and operates in synchronization with the line period of the inputted display data. The vertical counter 3307 also outputs a count value to the decoder 3309 as the output signal 3308. The decoder 3309 then generates an operation control signal 1104 based on the output signals 3308.

The vertical counter 3310 operates in response to the output control signal 1101, not in synchronization with the line period of the inputted display data but in synchronization with the line period of the outputted display data. The vertical counter 3310 then outputs a count value to the decoder 3312 as the output signal 3311. The decoder 3312 then generates the output select signal 1105 based on this output signal 3311.

Next, the scanning driver will be described using FIG. 7 and FIG. 19.

As shown in FIG. 19, the scanning driver of this embodiment divides the two inputted horizontal periods into three horizontal periods and shifts the shift clock group 706. The gate line group 710 is then sequentially selected using the shifted shift clock group 706. Vertical enlargement displaying is realized by the combined operation of the liquid crystal driver and the scanning driver.

Figure 2:
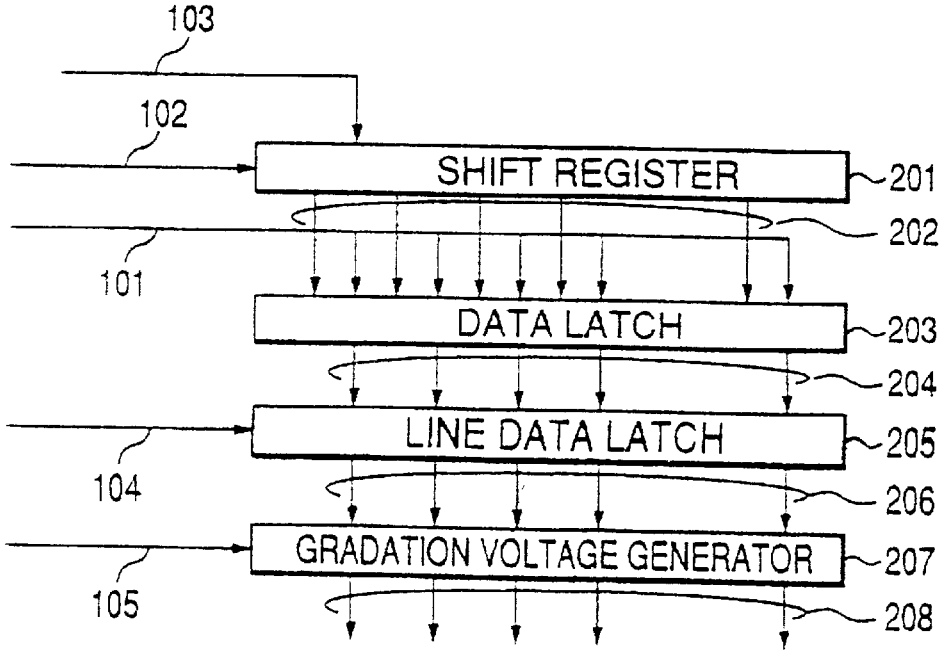
FIG. 2 is a block diagram showing the configuration of a related liquid crystal driver.
Figure 3:
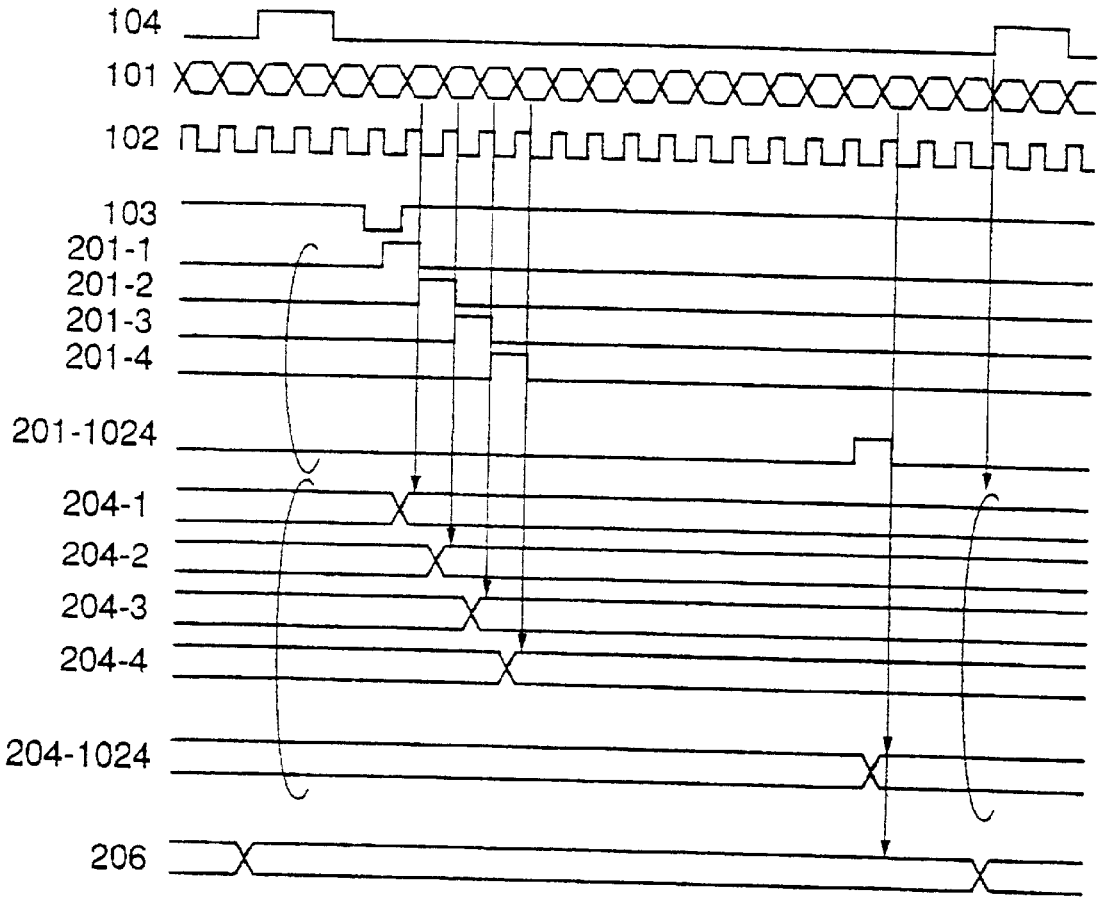
FIG. 3 is a timing chart showing the operation of a related liquid crystal driver.

The display conditions for the overall picture in this embodiment are the same as the display conditions for the first embodiment (refer to FIG. 9) but there is a distinction with regard to portions displaying fine characters, etc. As described previously, pixel data interpolated in this embodiment is generated as a result of arithmetic processing operations based on data for neighboring pairs of pixels. As a result, interpolation for neighboring pixels shown in black and white is displayed as half-tone display data as shown in FIG. 2A and FIG. 2B. The contents of the original display are therefore faithfully retained (reproduced) after enlargement without thin lines becoming thicker or thinner. In this embodiment, enlargement processing can be easily carried out even with low resolution display data.

Fourth Embodiment

A fourth embodiment will now be described using FIG. 21, FIG. 22, FIG. 23, FIG. 24 and FIG. 25.

Figure 21:
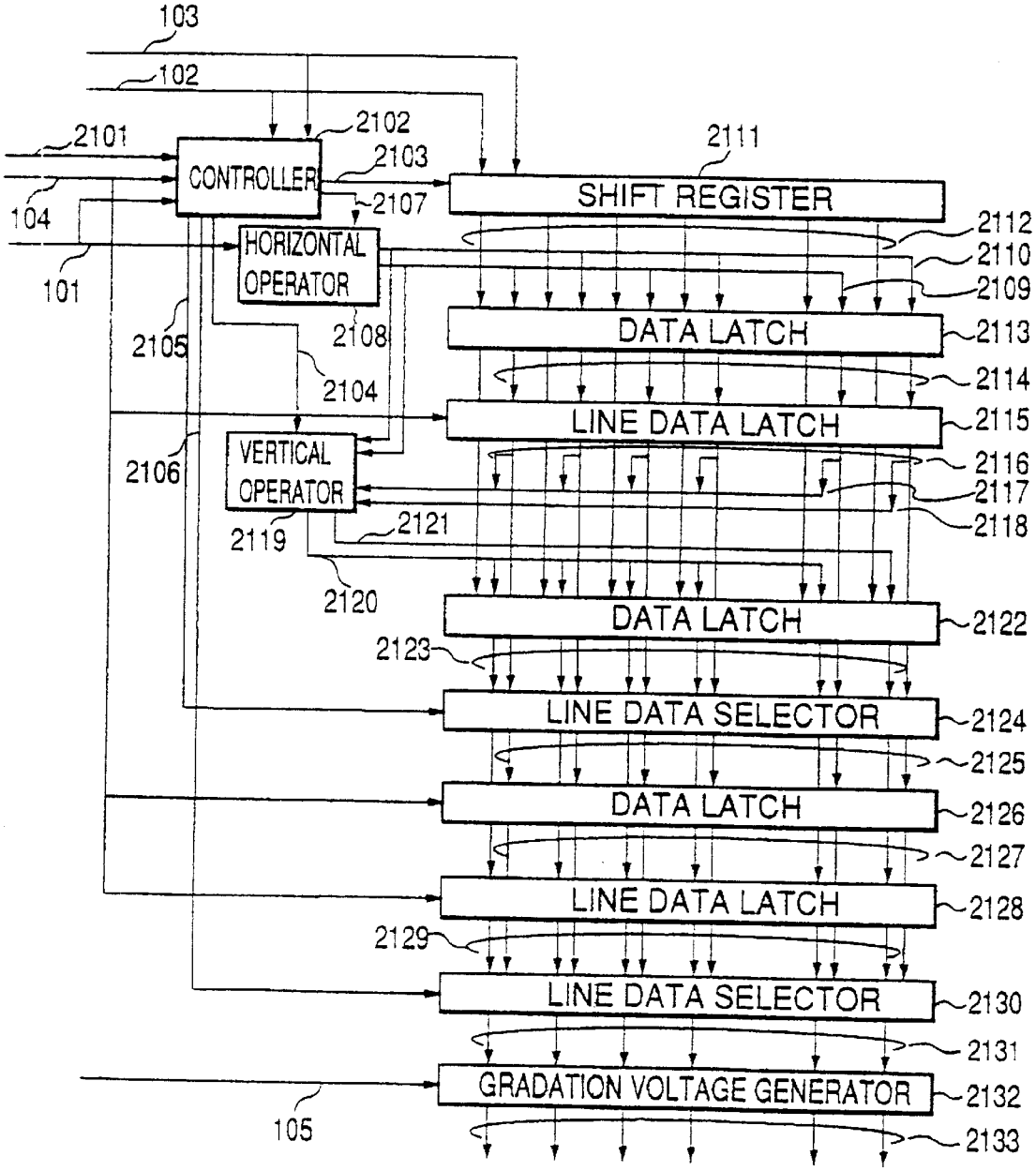
FIG. 21 is a block diagram of a liquid crystal driver of a fourth embodiment of the present invention.
Figure 22:
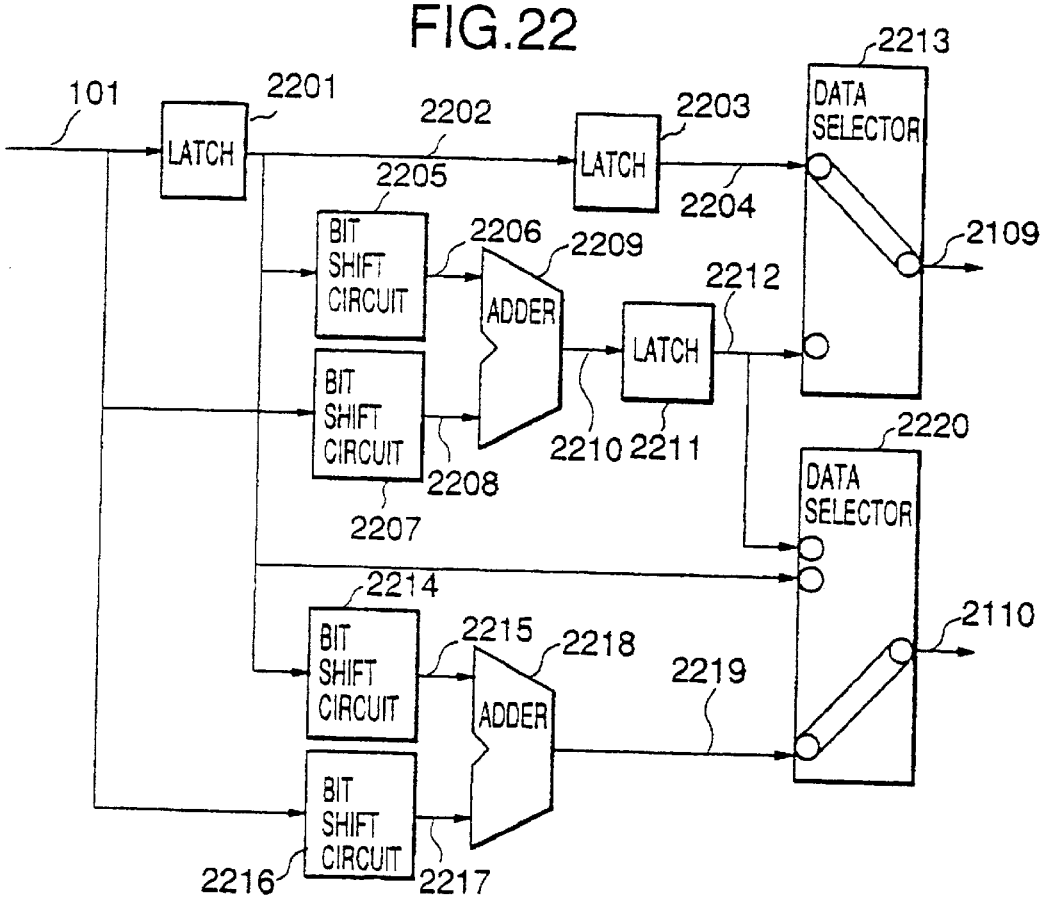
FIG. 22 is a block diagram of a horizontal operator.
Figure 23:
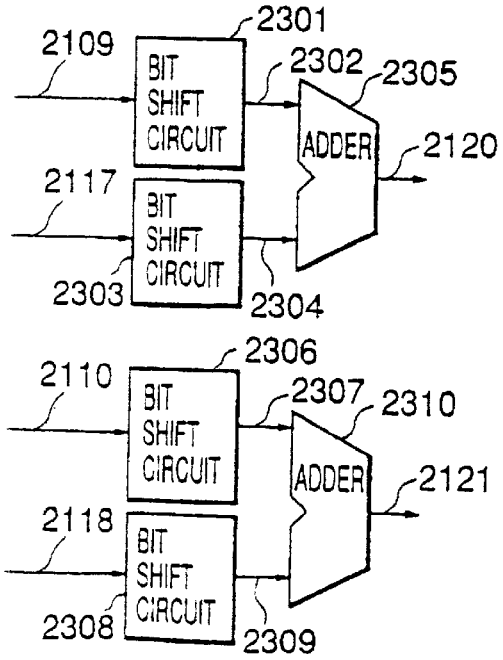
FIG. 23 is a block diagram of a vertical operator.
Figure 24:
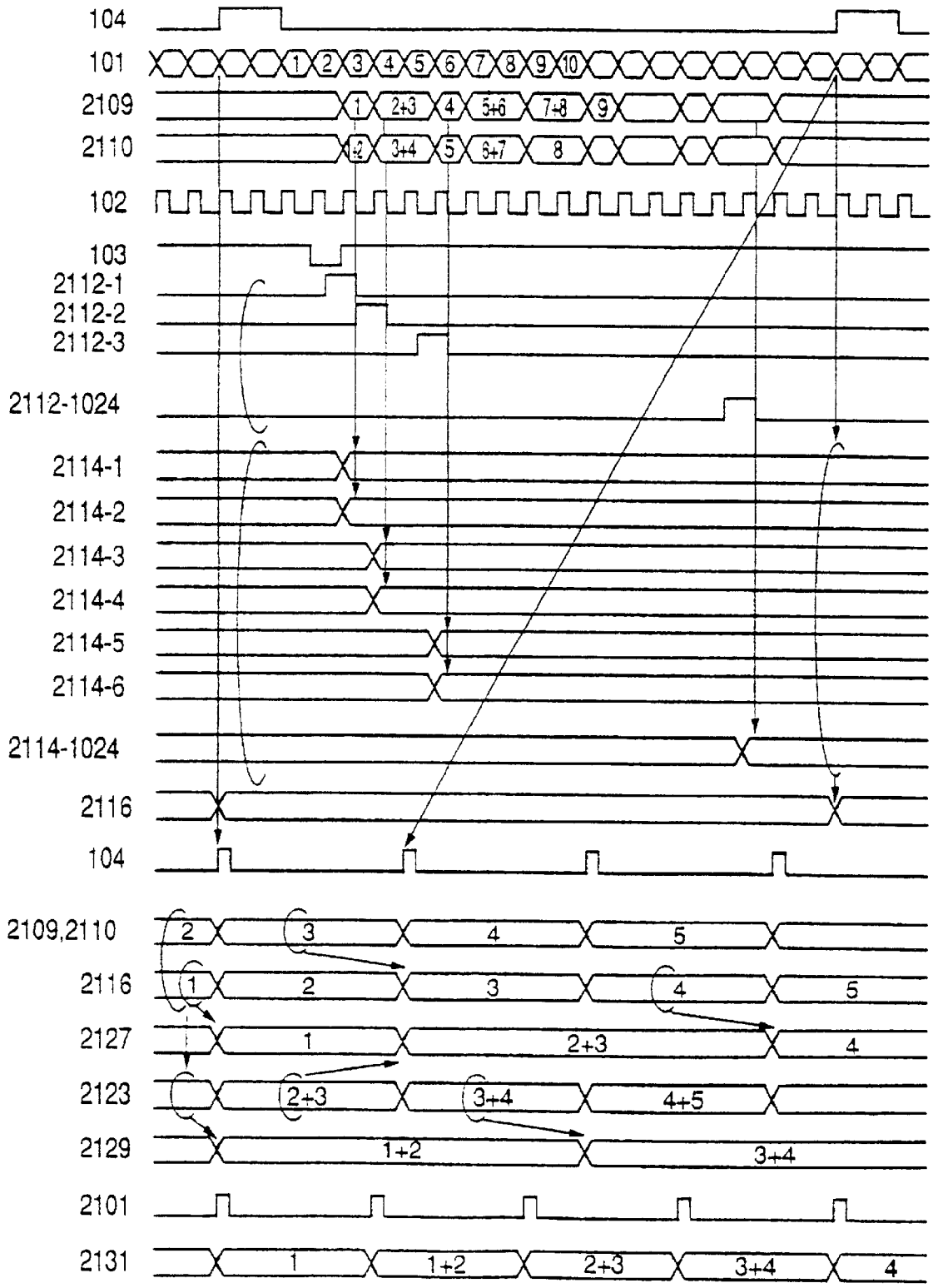
FIG. 24 is a timing chart showing the operation of a liquid crystal driver of the fourth embodiment.
Figure 25:
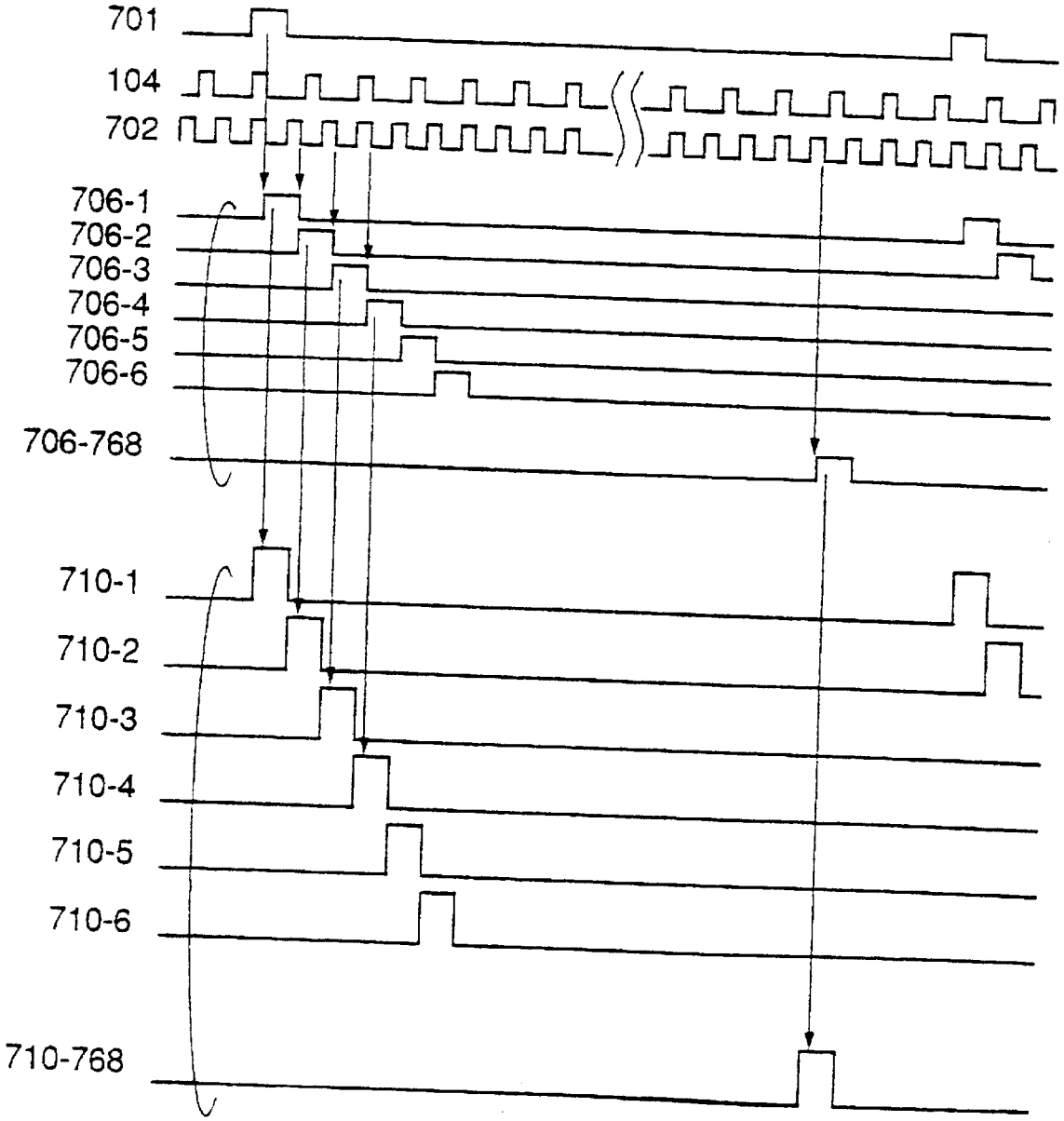
FIG. 25 is a timing chart showing the operation of a scanning driver of the fourth embodiment.
Figure 26A:
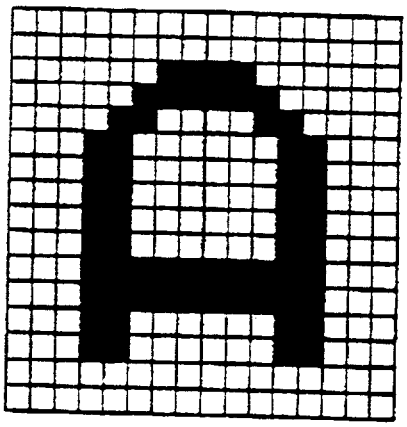
FIG. 26A and FIG. 26B are views showing examples of enlarged displays of the fourth embodiment.
Figure 26B:
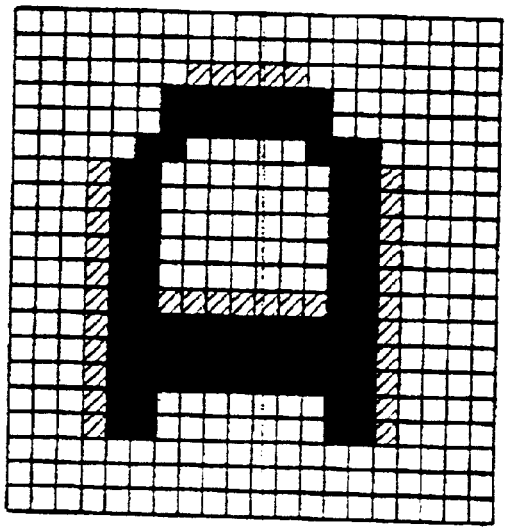

FIG. 21 is a block diagram of a liquid crystal driver of the present invention, FIG. 22 is a block diagram of a horizontal operator of the liquid crystal driver of the present invention, FIG. 23 is a block diagram of a vertical operation of the liquid crystal driver of the present invention, FIG. 24 is a timing chart showing the operation of a liquid crystal driver of the present invention, FIG. 25 is a timing chart of the operation of the scanning driver of the present invention and FIG. 26A and FIG. 26B are example displays of the present invention.

Here, inputted display data (of a resolution of 800 horizontal dots by 600 vertical lines) is enlarged by 1.25 times for displaying on a liquid crystal panel of a display region of 1024 horizontal dots by 768 vertical lines.

This liquid crystal driver comprises a controller 2102, horizontal operator 2108, shift register 2111, data latch 2113, line data latch 2115, vertical operator 2119, data latch 2122, line data selector 2124, data latch 2126, line data latch 2128, line data selector 2130 and gradation voltage generator 2132, together with signal lines and buses etc. connecting these items together.

The controller 2102 generates control signals 2103 and 2104 for controlling other operations of the shift registers, a data select signal 2105, an output select signal 2106 and an operation control signal 2107 based on the display data of the display data bus 101, clock (CL2) 102, display data capture start signal (EI) 103, horizontal synchronization signal (CL1) 104 and output control signal 2101. The control signal 2103 is outputted to the shift register 2111. The control signal 2104 is for vertical operation processing and is outputted to the vertical operator 2119. The data select signal 2105 is for selecting display data and is outputted to the data selector 2124. The output select signal 2106 is for selecting the gradation voltage outputted by the liquid crystal driver and is outputted to the line data selector 2130. The operation control signal is for horizontal operation processing and is outputted to the horizontal operator 2108. The output control signal 2101 is for controlling the timing of the gradation voltage outputted by the liquid crystal driver. The details of the controller 2101 are described later using FIG. 30.

The horizontal operator 2108 carries out enlargement processing in the horizontal direction and outputs display data after enlargement processing to the data latch 2113 and the vertical operator 2119, with odd pixel data being transmitted via the odd pixel data bus 2109 and even pixel data being transmitted via the even pixel data bus 2110. The details of the horizontal operator 2108 are described later using FIG. 22.

The vertical operator 2119 generates interpolated pixel data necessary for enlargement in the vertical direction for outputting to the data latch 2122, with generated interpolated pixel data for odd pixels being transmitted via the odd pixel data bus 2120 and data for even pixels being transmitted via the even pixel data bus 2121. The details of the vertical operator 2119 are described later using FIG. 23.

The essentials of the operation of the fourth embodiment will now be described with reference to FIG. 24.

The controller 2102 for the liquid crystal driver (refer to FIG. 21) outputs control signals 2103, 2107, 2104 and 2105, and an output select signal 2106.

The horizontal operator 2108 subjects inputted display data to horizontal enlargement processing in accordance with the control signal 2107. The display data after enlargement processing is then outputted to the data latch 2113 and the vertical operator 2119, with odd pixel data being transmitted via the odd pixel data bus 2109 and even pixel data being transmitted via the even pixel data bus 2110. The details of the horizontal enlargement processing are described in detail later using FIG. 22.

The shift register 2111 outputs a latch signal group 2112 in accordance with the control signal 2103. The data latch 2113 then sequentially stores display data transmitted via the data buses 2109 and 2110 in response to the latch signal group 2112. These conditions are listed in the timing chart for the data bus 2114 in FIG. 24.

When one horizontal line portion of display data is stored in the data latch 2113, the line data latch 2115 simultaneously stores display data sent via the data bus 2114 for transmission to the line data selector 2124 via the data bus 2116. Further, this stored display data is also transmitted to the vertical operator 2119, with odd pixel data being transmitted via the odd pixel data bus 2117 and even pixel data being transmitted via the even pixel data bus 2118.

The vertical operator 2119 generates vertical interpolation pixels based on the display data inputted via the data buses 2109 and 2110 and display data inputted via data buses 2116 and 2117 for outputting to the data latch 2122 via data buses 2120 and 2121. The operation for generating interpolated pixels using the vertical operator 2119 is described in detail later using FIG. 23.

The data latch 2122 sequentially stores display data inputted via the data buses 2120 and 2121 in response to the latch signal group 2112 and then outputs this data to the line data selector 2124 via the data bus 2123.

The line data selector 2124 selects one of either the display data inputted from the data latch 2122 and the display data inputted from the latch 2115 in response to the data select signal 2105 and then transmits this selected display data to the line data latches 2126 and 2128 via the data bus 2125. Each of the data latch 2126 and line data latch 2128 then transmits the stored display data to the line data selector 2130 via the data buses 2127 and 2129.

The line data selector 2130 selects one of either the display data sent via the data bus 2127 or the display data sent via the data bus 2129 in accordance with the output select signal 2106, with the selected display data being outputted to the gradation voltage generator 2132 via the data bus 2131. The gradation voltage generator 2132 changes display data inputted via the data bus 2131 to gradation voltages for outputting via a drain line group 2133 to the liquid crystal panel.

The operation of the line data selector 2124 will now be described using FIG. 24.

Display data that has been operated on at the vertical operator 2119 is sequentially latched at the data latch 2122.

When display data transmitted by the data bus 2116 is first line data, the line data selector 2124 causes the first line data transmitted via the data bus 2116 to be transmitted to the data latch 2126 so that the first line data appears on the data bus 2127.

At this time, the line data selector 2124 transmits display data computed from first line data and second line data appearing on the data bus 2123 to the line data latch 2128. Display data (listed as "1+2") computed from first line data and second line data therefore appears on the data bus 2129.

When display data transmitted by the data bus 2116 is second line data, the line data selector 2124 transmits display data computed from the second line data and the third line data appearing on the data bus 2123 to the line data latch 2126 so that display data (listed as "2+3") computed from the second line data and the third line data appears on the data bus 2127.

When display data transmitted by the data bus 2116 is third line data, the line data selector 2124 transmits display data computed from the third line data and the fourth line data appearing on the data bus 2123 to the line data latch 2128 so that display data (listed as "3+4") computed from the third line data and the fourth line data appears on the data bus 2129.

When the display data transmitted by the data bus 2116 is the fourth line data, the line data selector 2124 transmits fourth line data appearing on the data bus 2116 to the data latch 2126 so that fourth line data (listed as "4") appears at the data bus 2127. This is sequentially repeated by each circuit.

Interpolation pixels for the horizontal and vertical directions are generated from the above series of operations and enlargement processing for the liquid crystal driver is realized.

The details of the horizontal operator 2108 will now be described using FIG. 22 and FIG. 24.

The horizontal operator 2108 comprises latches 2201, 2203, 2211, bit shift circuits 2205, 2207, 2214 and 2216, adders 2209 and 2218, and data selectors 2213 and 2220, together with various signal lines and buses connecting these items together.

Odd pixel data generation processing and even pixel data generation processing is carried out in parallel within the horizontal operator 2108. In this embodiment, for simplicity, the coefficient for calculating display data appearing on the data buses 2109 and 2110 is not described.

First, the process for generating odd pixel data will be described.

The latch 2201 latches display data inputted via the display data bus 101 for outputting to the bit shift circuit 2205 via the data bus 2202.

Display data inputted via the display data bus 101 is also inputted directly to the bit shift circuit 2207. After both of the bit shift circuits 2205 and 2207 have subjected the pixel data generated to prescribed bit shift control, this data is outputted to the adder 2209 via the data buses 2206 and 2208. The adder 2209 then generates display data by adding display data inputted from the bit shift circuit 2205 and display data inputted from the bit shift circuit 2207.

In this case there is a phase difference of one clock between the display data inputted to the bit shift circuit 2207 via the display data bus 101 and the display data inputted to the bit shift circuit 2205 via the latch 2201 and the data bus 2202. Further, the bit shift circuits 2205 and 2207 subject inputted display data to prescribed bit shift control so as to generate five items of pixel data from four items of pixel data. Display data for three interpolation pixels is therefore generated in this way. When display data inputted sequentially via the display data bus 101 is taken to be X(n), X(n+1), X(n+2) and X(n+3), display data generated by the adder 2209 is as follows.

$$\tfrac{1}{4}\cdot X(n)+\tfrac{3}{4}\cdot X(n+1)$$

$$\tfrac{1}{2}\cdot X(n+1)+\tfrac{1}{2}\cdot X(n+2)$$

$$\tfrac{3}{4}\cdot X(n+2)+\tfrac{1}{4}\cdot X(n+3)$$

This is to say that display data is generated by carrying out processing giving weightings of ¼, ½ and ¾ to neighboring pairs of pixels.

The bit shift circuits of this embodiment are capable of ¼, ½, and ¾ times multiplication of the pixel data. Two bit shifting can be used to multiply the pixel data by ¼, one bit shifting can be used to multiply the pixel data by ½ and data shifted by two bits and data shifted by one bit can be added to multiply the pixel data by ¾. The bit shift circuits of this embodiment are shown to be circuits having these functions.

The adder 2209 outputs display data for generated interpolated pixels to the latch 2211. The latch 2211 temporarily stores this display data for transmission to the data selector 2213 via the data bus 2212.

The latch 2201 also outputs the latched display data to the latch 2203 via the data bus 2202. The latch 2203 then transmits the stored display data to the data selector 2213 via the data bus 2204.

The data selector 2213 selects one of the items of display data transmitted via the data buses 2204 and 2212 in accordance with the control signal 2107 for outputting to the odd pixel data bus 2109. The conditions for this selection by the data selector 2213 are shown in FIG. 24. Display data "1" appearing on the display data bus 2118 is sourced from the data bus 2204, display data "2+3" is display data sourced via the data bus 2212, display data "4" is display data sourced via the data bus 2204, display data "5+6" is display data sourced via the data bus 2212, and display data "7+8" is display data sourced via the data bus 2212.

Processing of even pixels will now be described.

After latching display data inputted via the display data bus 101, the latch 2201 transmits this display data to the bit shift circuit 2214 via the data bus 2202. The bit shift circuit 2114 then subjects the inputted display data to prescribed bit shift control and the data is outputted to the adder 2218 via the data bus 2215. The display data inputted via the display data bus 101 is also inputted directly to the bit shift circuit 2216. The bit shift circuit 2116 then subjects the inputted display data to prescribed bit shift control and outputs this display data to the adder 2218 via the data bus 2217. After adding the display data 2215 and the display data 2217, the adder 2218 outputs the resulting data to the data selector 2220 via the data bus 2219.

In this case, there is a phase difference of one clock portion between the display data inputted directly at the bit shift circuit 2216 from the display data bus 101 and the display data inputted at the bit shift circuit 2214 via the latch 2201 and the data bus 2202. When the display data is taken to be X(m), X(m+1), X(m+2) and X(m+3), the display data generated and outputted by the adder 2218 carries out processing so as to give weightings of ¼, ½ and ¾ to neighboring pairs of pixels as follows.

$$\tfrac{1}{4}\cdot X(m)+\tfrac{3}{4}\cdot X(m+1)$$

$$\tfrac{1}{2}\cdot X(m+1)+\tfrac{1}{2}\cdot X(m+2)$$

$$\tfrac{3}{4}\cdot X(m+2)+\tfrac{1}{4}\cdot X(m+3)$$

Three items of interpolated pixel data can also be generated in this way for even pixel data in the same way as for odd pixel data.

The latch 2201 also transfers stored display data to the data selector 2220 via the data bus 2202.

The data selector 2220 selects one of the items of display data inputted via the data buses 2212, 2202 and 2219 as appropriate for outputting to the data latch 2113 via the even pixel data bus 2110. The conditions for selecting by the data selector 2220 are shown in FIG. 24. The display data "1+2" appearing on the display data bus 2110 is sourced at the data bus 2212, the display data "3+4" is sourced at the data bus 2219, the display data "5" is sourced at the data bus 2202, the display data "6+7" is sourced at the data bus 2219 and the display data "8" is sourced at the data bus 2202.

Next, the details of the vertical operator 2119 are described using FIG. 23.

Display data coming via the data buses 2109 and 2110 and display data coming via the data buses 2117 and 2118 are inputted to the vertical operator 2119.

Display data inputted via the data buses 2117 and 2118 is delayed by one horizontal line portion with respect to display data inputted via the data buses 2109 and 2110 because this display data has passed once through the line data latch 2115 (refer to FIG. 21).

Display data that has passed through the data bus 2109 is bit shifted by the bit shift circuit 2301 and transmitted to the adder 2305 via the data bus 2302. Further, display data passing through the data bus 2117 is similarly bit shifted at the bit shift circuit 2303 and transmitted to the adder 2305 via the data bus 2304. The adder 2305 then adds the inputted display data for outputting to the data latch 2122 (refer to FIG. 21) via the data bus 2120. When the display data inputted at the vertical operator 2119 is taken to be Y(n), Y(n+1), Y(n+2) and Y(n+3), display data outputted via the odd pixel data bus 2120 is taken to be display data for carrying out processing by giving weightings of ¼, ½ and ¾ to pairs of neighboring pixels, as is shown in the following.

$$\tfrac{1}{4}\cdot Y(n)+\tfrac{3}{4}\cdot Y(n+1)$$

$$\tfrac{1}{2}\cdot Y(n+1)+\tfrac{1}{2}\cdot Y(n+2)$$

$$\tfrac{3}{4}\cdot(n+2)+\tfrac{1}{4}\cdot Y(n+3)$$

As with the horizontal operator 2108, the vertical operator 2119 also generates three interpolated pixels from four pixels.

The data for the even pixels inputted via the data buses 2120 and 2118 can also be subjected to processing by the bit shift circuit 2306 and 2308 and the adder 2310 in the same manner. Vertical interpolation pixel data for generated even pixel display data is outputted to the latch 2120 via the data bus 2121.

Figure 30:
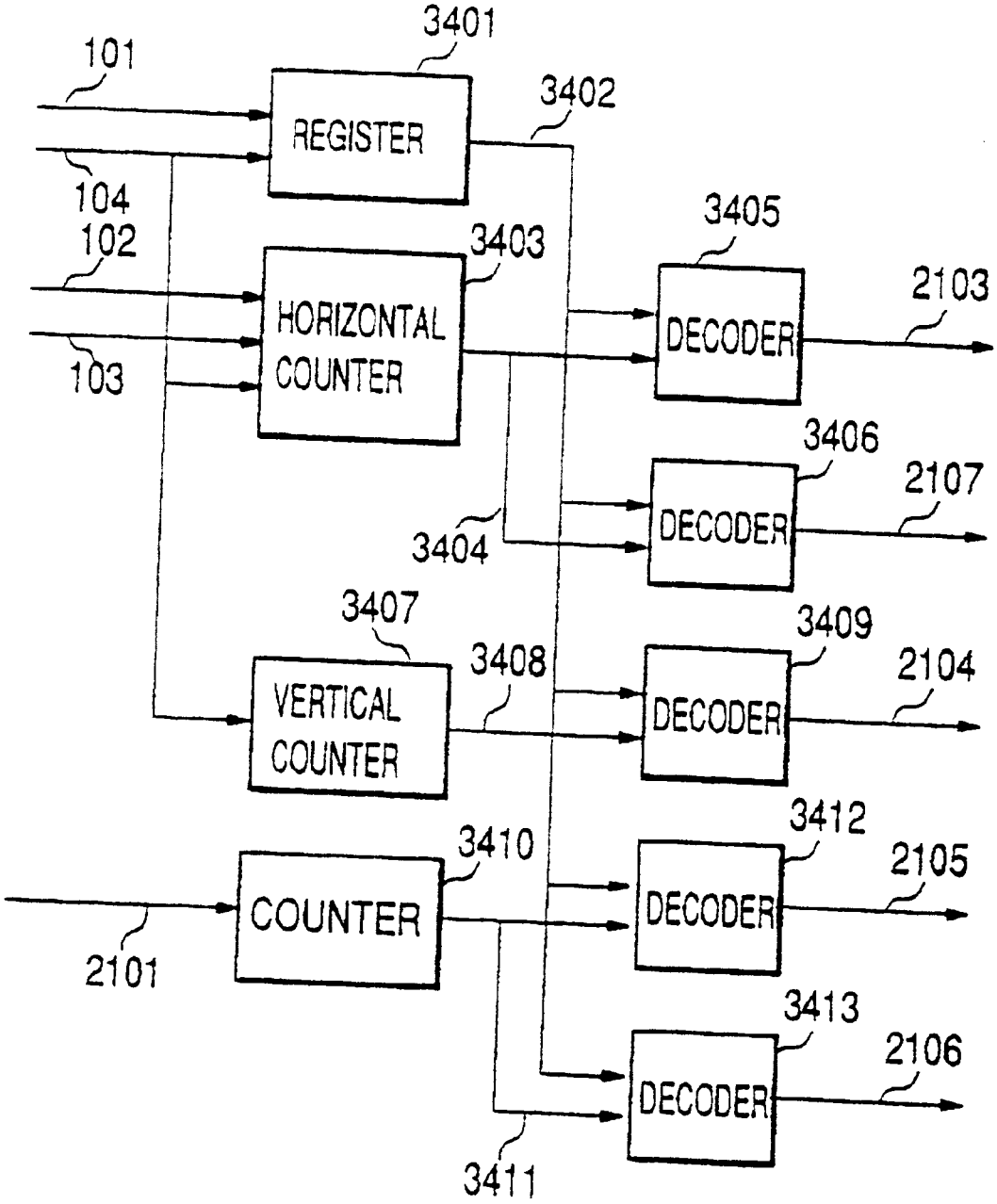
FIG. 30 is a block diagram showing a controller 2102 of the fourth embodiment.

The details of the controller 2102 are described using FIG. 30.

The controller 2102 comprises a register 3401, horizontal counter 3403, decoders 3405, 3406, 3409, 3412 and 3413 and vertical counters 3407 and 3410, together with various signal lines and buses connecting these items together.

The register 3401 stores data for control use transmitted via the display data bus 101. This data for control use can be transmitted during the flyback period when display data is not being transmitted. The register 3401 then transmits the stored data for control use to the decoders 3405, 3406, 3409, 3412 and 3413 via a control data bus 3402.

The counter 3403 operates in response to the clock 102, the display data capture start signal 103 and the horizontal synchronization signal 104, and outputs a count value to decoders 3405 and 3406 as an output signal 3404. The decoder 3405 then generates the control signal 2103 based on these signals, and the decoder 3406 generates the control signal 2107 based on these signals.

The counter 3407 operates in response to the horizontal synchronization signal 104 and therefore operates in synchronization with the line period of the inputted display data so as to output a count value to the decoder 3409 as the output signal 3408. The decoder 3409 then generates a control signal 2104 based on this output signal 3408.

The counter 3410 operates in response to the output control signal 2101 and therefore operates in synchronization with the line period of the output display data rather than in synchronization with the line period of the inputted display data. The counter 3410 outputs a count value to decoders 3412 and 3413 as an output signal 3411. The decoder 3412 then generates the data select signal 2105 based on this output signal 3411, and the decoder 3413 generates an output select signal 2106.

Next, the scanning driver is described using FIG. 7 and FIG. 25.

The basic configuration of the scanning driver is the same as for the case shown in FIG. 7, except for that four inputted horizontal periods are divided into five horizontal periods and the shift clock group 706 is shifted in the way shown in FIG. 25. The gate line group 710 gradually attains the sequential selected state shown in FIG. 25 in line with the shift clock group 706. Expansion in the vertical direction can then be realized through combination with the liquid crystal driver of this embodiment.

The display conditions for the overall picture in the fourth embodiment are the same as the case for the second embodiment (refer to FIG. 13). However, there is a distinction in the displaying of fine display characters etc. As described previously, interpolated pixel data is generated by subjecting neighboring pairs of source pixel data to arithmetic processing operations. Interpolation for neighboring black and white portions is therefore displayed as half-tone display data (refer to FIG. 26A and FIG. 26B). Thin lines therefore do not become thicker or thinner, i.e. display data is therefore faithfully maintained (reproduced) after enlargement.

Arbitrary enlargement processing can therefore be easily carried out by the third and fourth embodiments even with low resolution display data, as is also the case for color displaying.

In the third and fourth embodiments, neighboring pixel data is calculated by a horizontal operator and a vertical operator, but, rather than carrying out this operation processing, if another pixel data transmitting process is carried out, the same display results as for the first and second embodiments can be obtained.

Fifth Embodiment

Next, a fifth embodiment of the present invention is described using FIG. 31 to FIG. 36.

In this fifth embodiment, enlargement displaying of 1.5 times is carried out as in the first embodiment. However, whereas a plurality of gate lines were selected simultaneously in the first embodiment to perform enlargement in the vertical direction, in this fifth embodiment gate electrodes are selected one at a time and expansion is carried out in the vertical direction by regulating the timing of the gradation voltages for the drain line.

Figure 31:
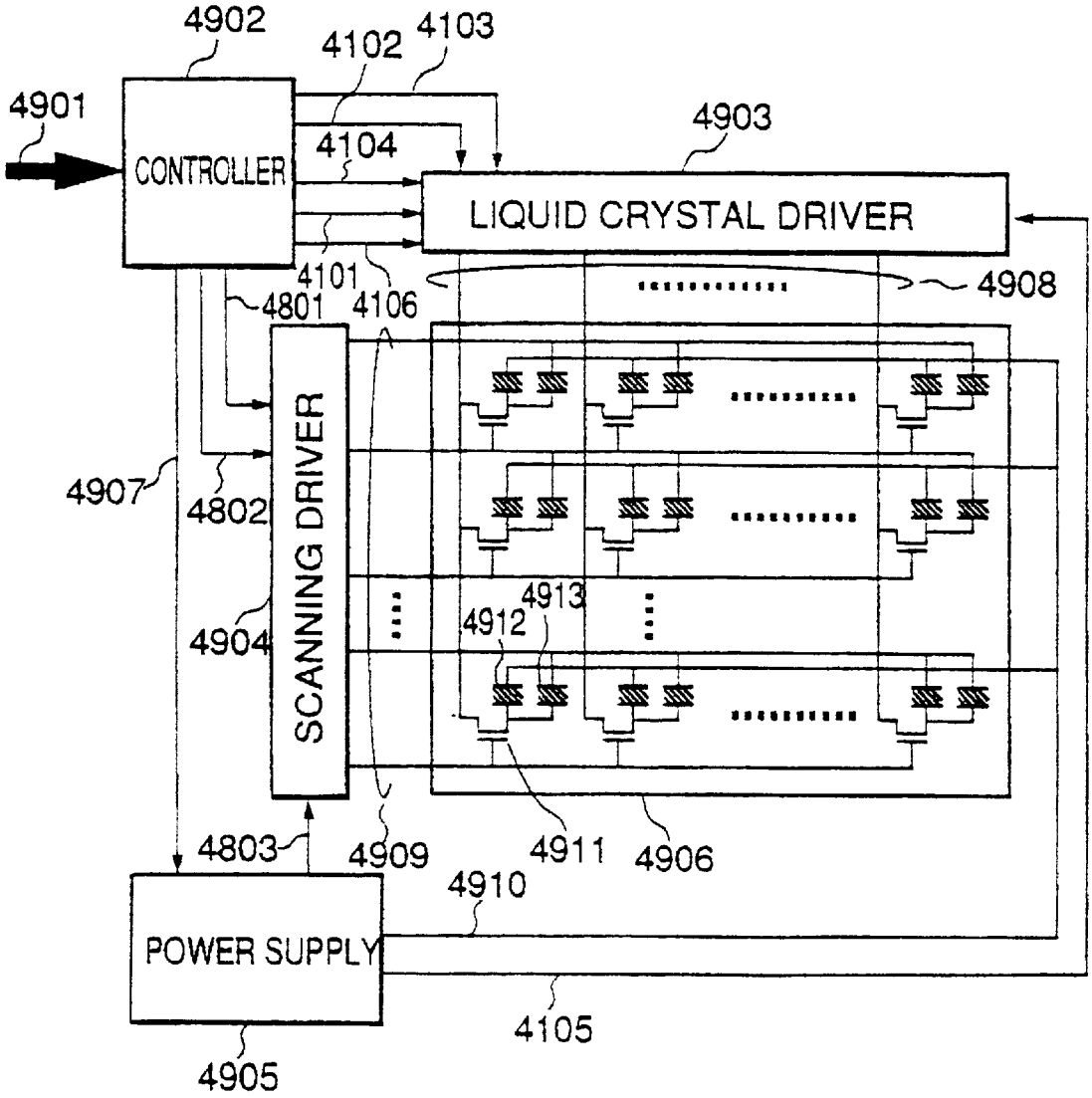
FIG. 31 is a block diagram of a liquid crystal display relating to a fifth embodiment of the present invention.

FIG. 31 is a view of the configuration of the liquid crystal display relating to the fifth embodiment of the present invention.

In FIG. 31, the liquid crystal display is configured from a controller 4902 for generating liquid crystal driving display data and various timing signals, a liquid crystal panel 4906, a liquid crystal driver 4903 for generating a gradation voltage, a scanning driver 4904 for generating a line select voltage or a line de-select voltage and a power supply 4905 for generating a liquid crystal driving voltage.

The controller 4902 generates various timing signals for liquid crystal-driving based on display data supplied from a system (not shown in the drawings) via the data bus 4901 and the synchronization signals. Pixel parts comprising a thin film transistor ("TFT") 4911, a liquid crystal 4912 and a supplementary capacitor 4913 are provided at the liquid crystal panel 4906. At each of the pixel parts, when the TFT 4911 goes on due to a selection voltage provided via a gate line group 4909, gradation voltages supplied via a drain line group 4908 and a voltage supplied via a power supply line 4910 are applied to the liquid crystal 4912 and the supplementary capacitor 4913, and gradation displaying is carried out in response to this potential difference. At this liquid crystal panel 4906, the supplementary capacitor 4913 of the pixel part for which the TFT 4911 has gone on is configured so as to be connected to a separate neighboring gate line so that two select voltage cannot be applied to a neighboring gate lines at the same time. The power supply 4905 generates a voltage to be utilized in the generation of the line select voltage and gradation voltage by the liquid crystal driver 4903 and the scanning driver 4904, with the polarity of this voltage being flipped backwards and forwards in accordance with the alternating signal of the signal line 4907.

Figure 32:
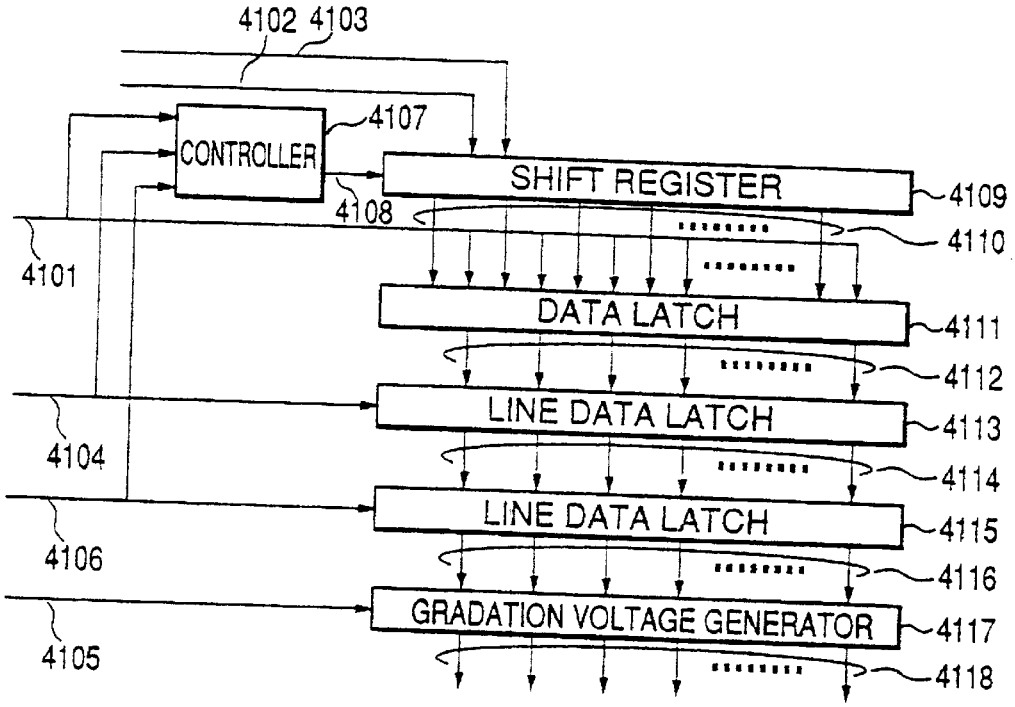
FIG. 32 is a block diagram of a liquid crystal driver.

FIG. 32 shows the block configuration of the liquid crystal driver 4903.

In FIG. 32, the liquid crystal driver 4903 is configured from a shift register 4109 for generating timing, a controller 4107 for controlling operations of the shift register 4109, a data latch 4111 for capturing, storing and outputting one line portions of display data in pixel units for the liquid crystal panel, a line data latch 4113, a line data latch 4115 and a gradation voltage generator 4117.

Display data 4101, a clock 4102 giving the transmission timing of the display data 4101, a display data capture start signal 4103, a horizontal data synchronization signal 4104 for taking the horizontal period of the display data as the periodicity, and a horizontal scanning period signal 4106 synchronized with the scanning period of the scanning driver (to be described later) are supplied to the liquid crystal driver 4903 by the controller 4902 of FIG. 31. The shift register 4109 generates a latch signal group 4110 giving the display data storage position and storage timing based on these signals and outputs this latch signal group 4110 to the data latch 4111. The latch signal group 4110 comprises the same number of latch signals as the drain line group 4908 of the liquid crystal panel 4906, with pixel unit latch circuits being arranged at the data latch 4111 so as to correspond to each latch signal. The data latch 4111 sequentially stores transmitted display data 4101 in accordance with the latch signal group 4110 and outputs the stored display data to a data bus 4112. The line data latch 4113 simultaneously captures and stores data on the data bus 4112 on the timing of the synchronization signal 4104 and outputs the stored display data to a data bus 4114. The line data latch 4115 simultaneously captures and stores data on the data bus 4114 on the timing of a synchronization signal 4104 and outputs the stored display data to the data bus 4114. The gradation voltage generator 4117 selects a gradation voltage corresponding to the display data on the data bus 4114 from within the reference gradation voltage 4105 for outputting to a drain line group 4118 (4908).

Figure 33:
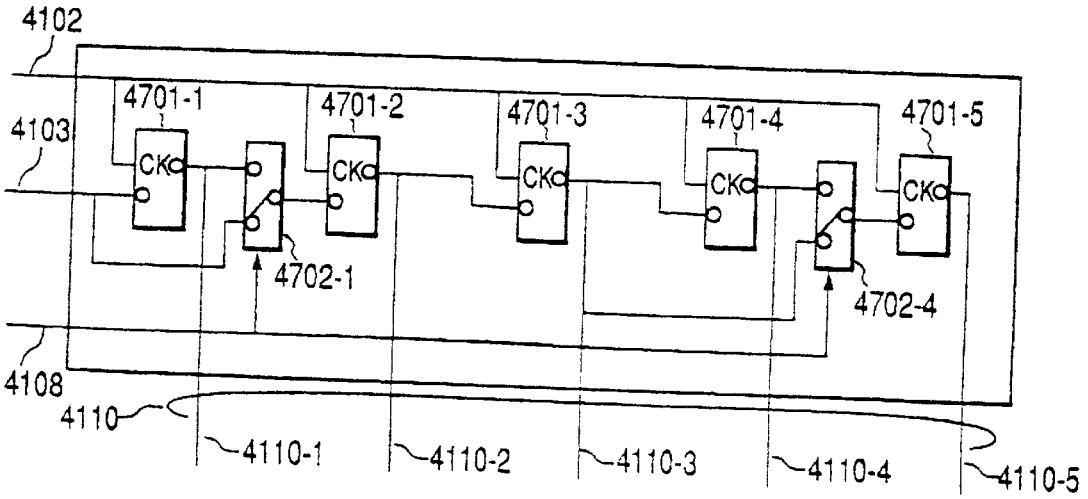
FIG. 33 is a block diagram of a shift register within a liquid crystal driver.

The details of the shift register 4109 will now be described using FIG. 33. In FIG. 33, the portions relating to the generation of five latch signals i.e. flip-flops (hereinafter referred to as "FF") 4701-1 to 4701-5 comprising the shift register and selectors 4702-1 and 4702-4 switching over the inputs of FF4701-2 and 4701-5) are shown within the structure of the shift register 4109. Each FF 4701 captures, saves, and outputs from a Q terminal, data inputted at a D terminal on the timing of the clock 4102 inputted at the terminal CK. The output of the Q terminal of each FF4701 is outputted as the latch signal group 4110. In the above configuration, the valid level of the display data capture start signal 4103 is sequentially shifted first by FF4701-1 and 4701-2, then by FF4701-3, then by FF4701-4 and 4701-5 in synchronization with the display data clock 4102. In this way, two latch signals simultaneously become valid levels within one period of the clock 4102. The state of a selector 4702 is switched by a switching signal 4108 and the outputs of FF4701-1 to 4701-5 are sequentially put to valid levels one at a time.

Figure 34:
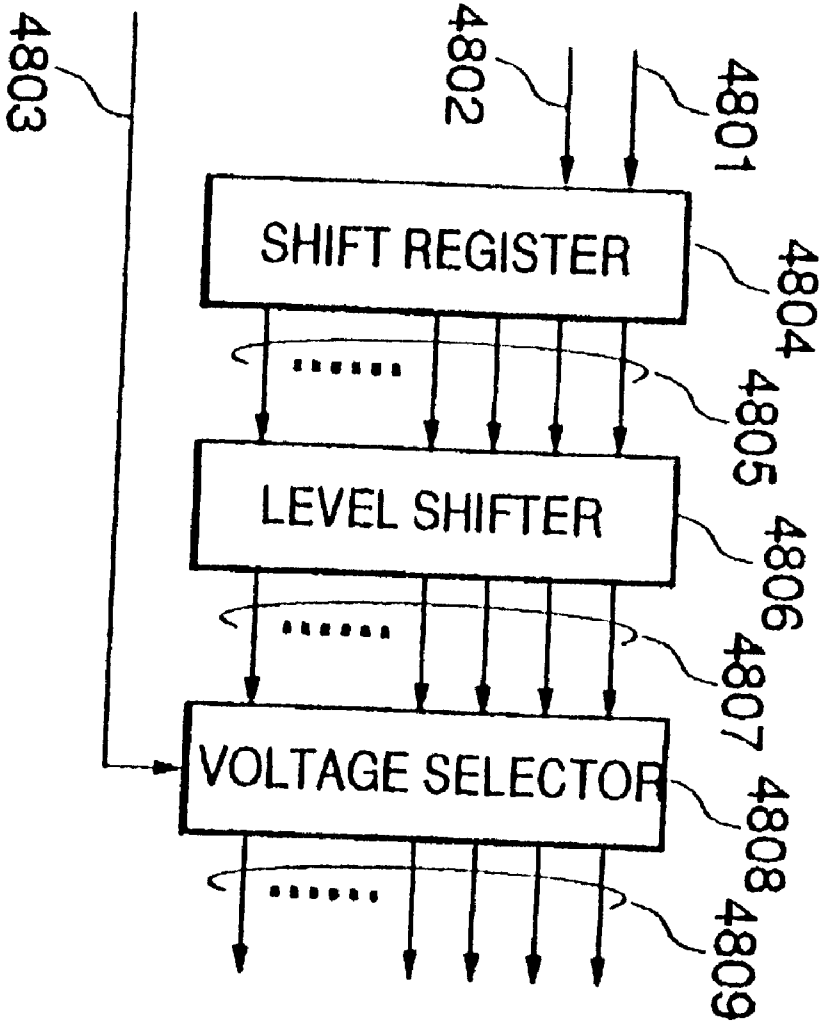
FIG. 34 is a block diagram of a scanning driver.

FIG. 34 shows the configuration of the scanning driver.

In FIG. 34 the scanning driver comprises a shift register 4804, a level shifter 4806 and a voltage selector 4808. The shift register 4804 outputs a shift clock group 4805 having the same number of shift clock lines as there are gate lines in the gate line group 4909 for the liquid crystal panel 4906. When a line scan start signal 4801 then becomes valid, the shift clock group 4805 becomes valid levels one at a time in order from the head in accordance with a line shift clock 4802. This shift clock group 4805 is then supplied to the voltage selector 4808 after the voltage levels are changed by the shift register 4804. The voltage selector 4808 outputs select voltages or de-select voltages corresponding to the voltage levels of each of the shift clocks for the supplied shift clock group 4805 as a gate select group 4809 (gate line group 4909) selected from a voltage supplied from a power supply line 4803. At this time, the voltage selector 4808 outputs select voltages to gate lines corresponding to valid level shift clocks and outputs de-select voltages to remaining gate lines.

Figure 35:
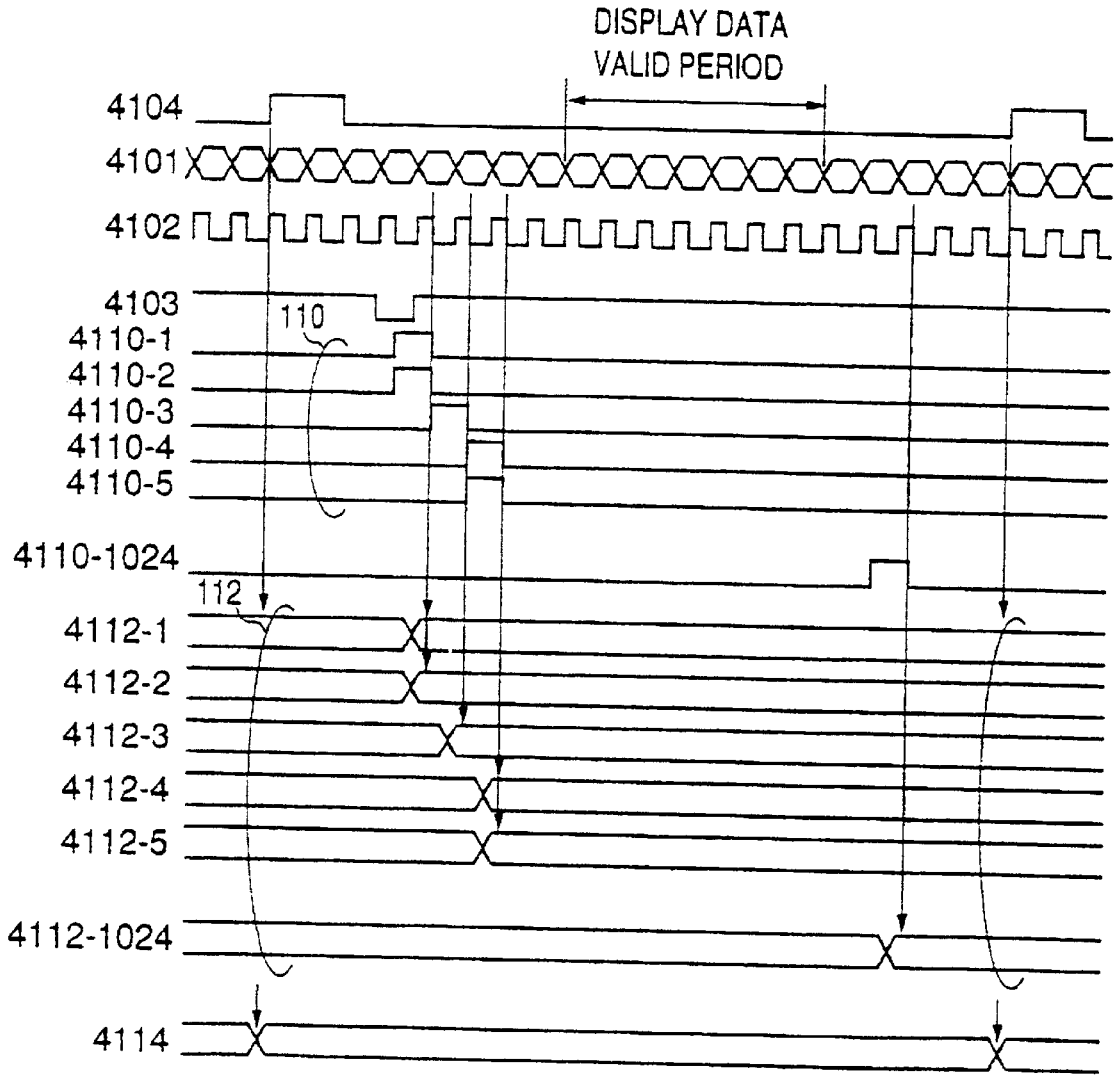
FIG. 35 is a timing chart showing the operation of a liquid crystal driver.
Figure 36:
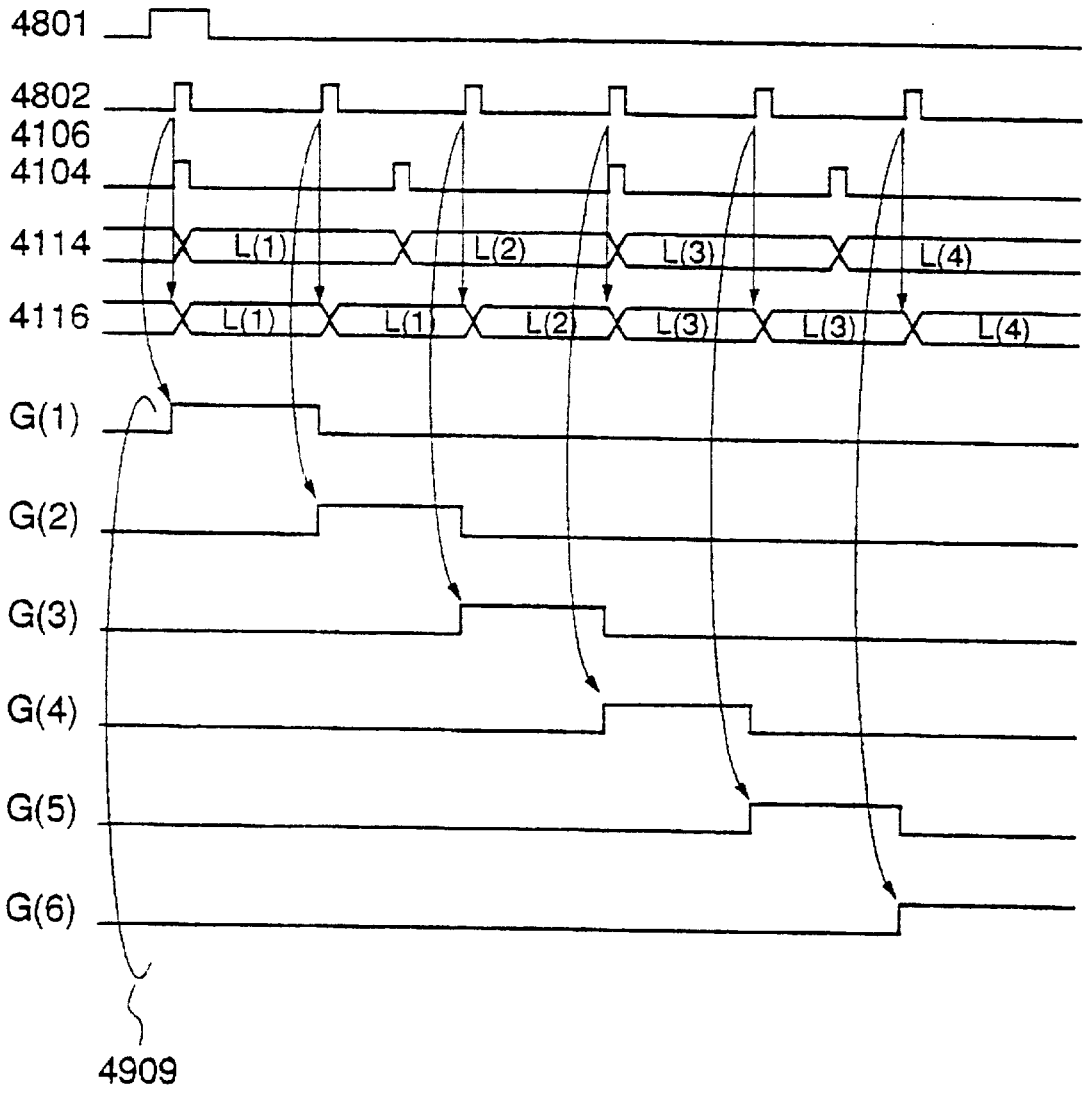
FIG. 36 is a timing chart showing the operation of a scanning driver and a liquid crystal driver.

The operation of the liquid crystal display of this embodiment is now described using FIG. 35 and FIG. 36. FIG. 35 and FIG. 36 are timing charts showing the operation of the liquid crystal display.

Here, a description is given taking the resolution of the liquid crystal panel 4906 to be 1024 horizontal dots by 768 vertical lines and the resolution of the inputted display data to be 640 horizontal dots by 480 vertical lines similar to the configuration of the first embodiment.

As shown in FIG. 35, at the liquid crystal driver of FIG. 32, when the level of the display data capture start signal 4103 becomes a valid level (low level), the operation of the shift register 4109 commences. The shift register 4109 first simultaneously makes the latch signals 4110-1 and 4110-2 valid in synchronization with the clock 4102, then makes the latch signal 4110-3 valid, so as to sequentially make the latch signals 4110 valid two and then one at a time thereafter. As a result of this, at the data latch 4111, the same display data is first simultaneously stored at latches corresponding to the latch signals 4110-1 and 4110-2, with the following display data then being stored at a latch corresponding to the latch signal 4110-3. In this way, the display data 4101 is stored as partially duplicated display data at the data latch 4111. The display data of the data latch 4111 is captured and stored simultaneously at the line data latch 4113 using the horizontal data synchronization signal 4104. The display data of the line data latch 4113 is stored at the line data latch 4115 using the synchronization signal 4106. Further, the gradation voltage is outputted to the drain line group 4118 based on the display data of the line data latch 4115. The display data capture start position can be changed using the display data capture start signal 4103.

On the other hand, at the scanning driver 4904 of FIG. 34, as shown in FIG. 36, when the line scan start signal 4801 becomes valid, a select voltage is outputted to the gate line for the first horizontal line within the gate line group 4909, with de-select voltages being outputted to remaining gate lines. The gate line to which the select voltage is outputted is then sequentially transferred from the gate line for the leading line to the gate line of the final line in synchronization with the shift clock 4802. The shift clock 4802 also changes the gradation voltage outputted by the liquid crystal driver 4903 every time the gate line to which the select voltage is outputted is transferred in synchronization with the horizontal scanning period signal 4106 supplied to the line data latch 4115 of the liquid crystal driver 4903. The horizontal data synchronization signal 4104 of the line data latch 4113 has a period of 1.5 times the period of the horizontal scanning period signal 4106 of the line data latch 4115. Because of this, when the line scan start signal 4801 becomes valid, the liquid crystal driver 4903 outputs gradation voltages based on display data L(1) for the same one line portion during the first two periods of the horizontal scanning period signal 4106 and outputs a gradation voltage based on display data L(2) for the next one line portion in the next one period. In this way, displaying is carried out at the pixel parts for the first and second lines based on the same one line portion of display data L(1) and displaying is carried out at the pixel part for the third line based on the next one line portion of display data L(2). As a result, a display expressed by 640 dot by 480 line display data is displayed on the liquid crystal panel enlarged by 1.5 times in the horizontal and vertical directions. This displaying is the same as that described in the first embodiment using FIG. 9, FIG. 10A and FIG. 10B.

With the liquid crystal display of this embodiment, when the image resolution expressed by the inputted display data 4101 is the same as the resolution of the liquid crystal panel 4906, displaying can be carried out at a normal ratio by switching the state of the selector 4702 for the shift register shown in FIG. 33. Further, a shift register capable of arbitrarily switching over inputs of each FF described in FIG. 27 and FIG. 28 is utilized as the shift register 4109. Enlargement and displaying at an arbitrary rate is then possible by changing the timing of the latch signal group 4110 generated by this shift register and the timing of the horizontal data synchronization signal 4104 and the horizontal scanning period signal 4106. The same enlargement and displaying is also possible for color displaying.

Sixth Embodiment

Next, a sixth embodiment of the present invention will be described using FIG. 37 to FIG. 39.

This embodiment carries out displaying enlarged by 1.25 times in the same way as the second embodiment and has the same configuration as the fifth embodiment with the exclusion of the shift register of the liquid crystal driver.

Figure 37:
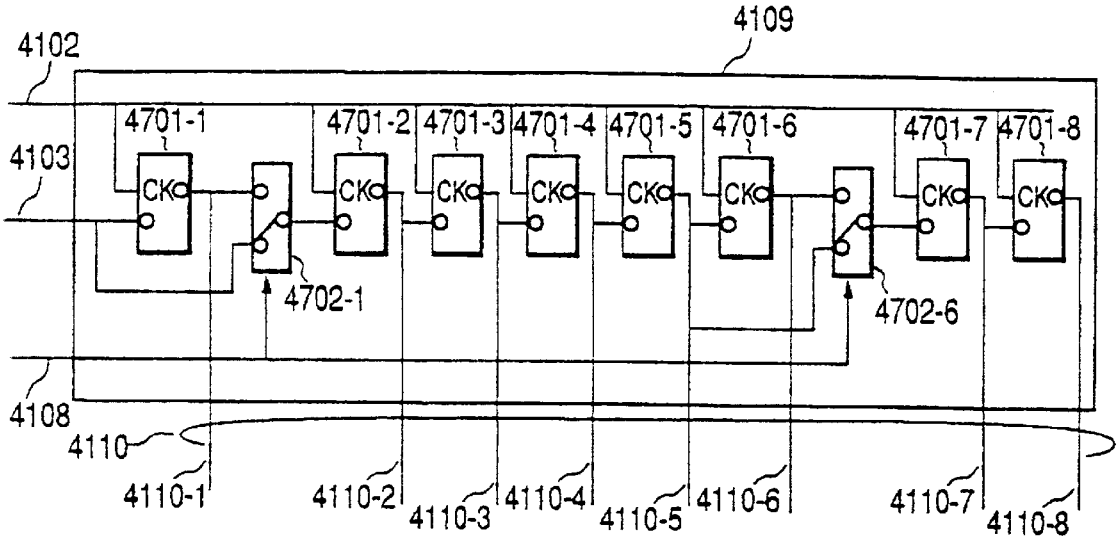
FIG. 37 is a block diagram of a shift register of a liquid crystal driver of a sixth embodiment of the present invention.

FIG. 37 is a block diagram of the shift register 4109 of the liquid crystal driver 4903 of the sixth embodiment. FIG. 37 shows the configuration relating to the generation of eight latch signals, i.e. shows the selectors 4702-1 and 4702-6 for switching the flip-flops (FF) 4701-1 to 4701-8 comprising the shift register and the inputs of FF4701-2 and 4701-7. The function of each FF and the selector is the same as described in FIG. 33. In the configuration in FIG. 37, the valid level of the display data capture start signal 4103 in synchronization with the clock 4102 for the display data is first captured at FF4701-1 and 4701-2, then sequentially captured by FF4701-3, FF4701-4 and then 4701-5, and then simultaneously captured at FF4701-6 and 4701-7. Two latch signals therefore simultaneously become valid levels within one period of four periods of the clock 4102. Therefore, with this shift register, as with that of the fifth embodiment, the state of the selector 4702 is switched over and the outputs of FF4701-1 to 4701-8 are sequentially made to be valid levels one at a time.

Figure 38:
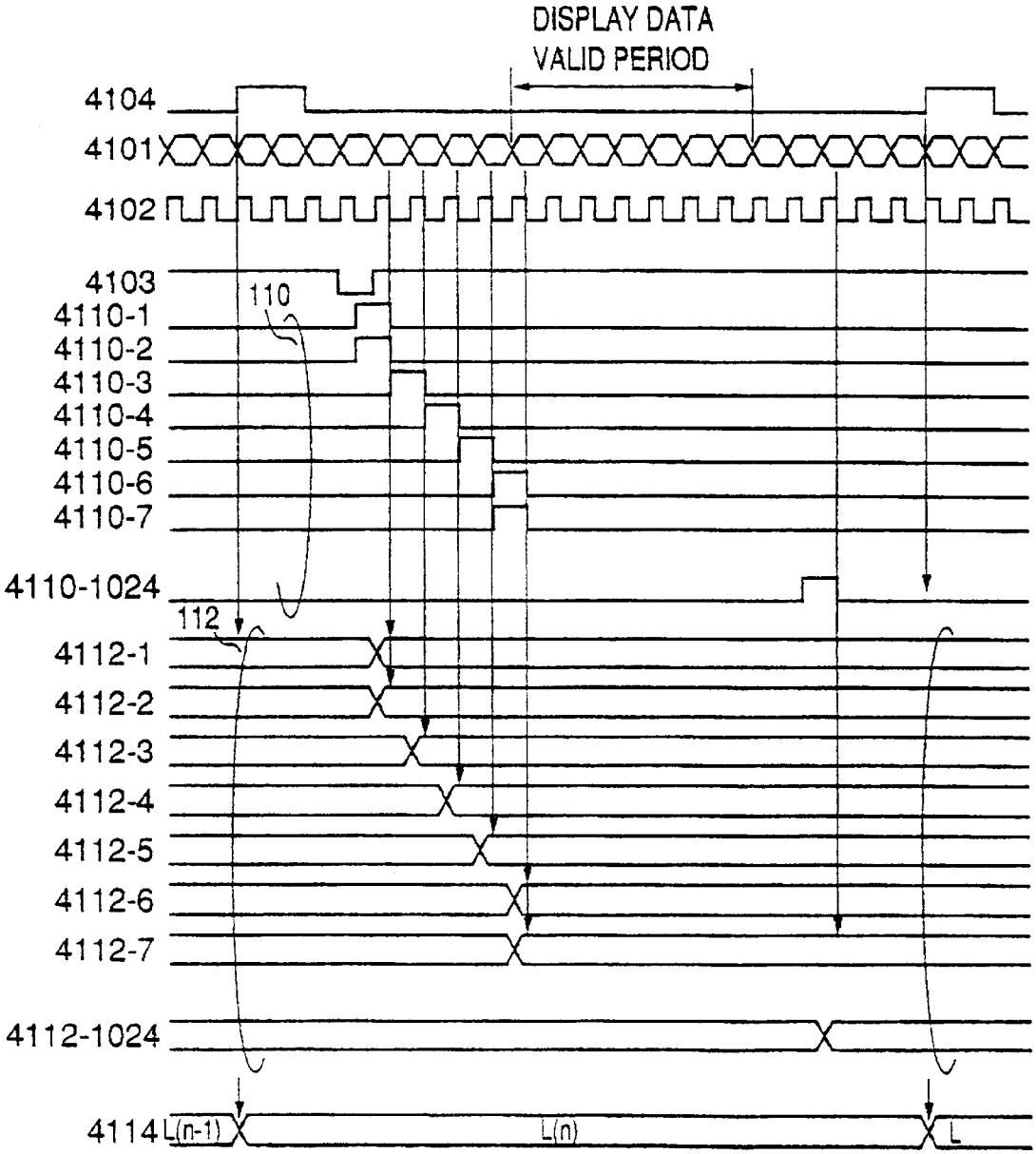
FIG. 38 is a timing chart showing the operation of a liquid crystal driver.
Figure 39:
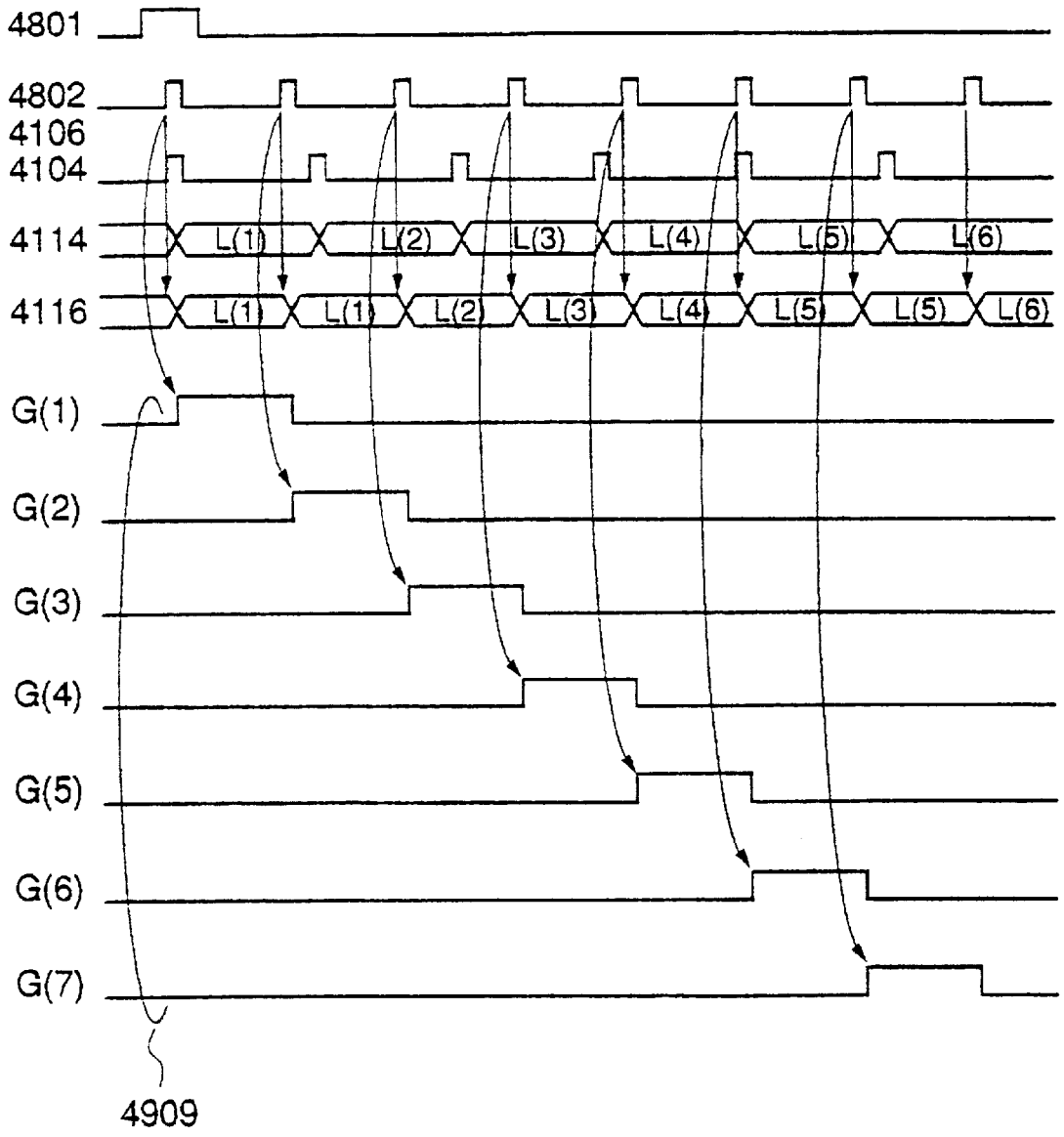
FIG. 39 is a timing chart showing the operation of a scanning driver and a liquid crystal driver.

FIG. 38 and FIG. 39 are timing charts showing the operation of the liquid crystal display of this embodiment.

In the following, as in the second embodiment, the operation of a liquid crystal display where the resolution of the liquid crystal panel 4906 is 1024 horizontal dots by 768 lines and the resolution of the inputted display data is 800 horizontal dots by 600 vertical lines will be described.

As shown in FIG. 38, the liquid crystal driver operates in the same way as in the fifth embodiment (refer to FIG. 35) with the exception of the same display data being stored at two latches within the data latch 4111 at the rate of one time per four periods of the clock 4102.

At the data latch 4111 the same display data is first stored simultaneously at latches corresponding to the latch signals 4110-1 and 4110-2 in accordance with the aforementioned latch signal group and is then sequentially stored at latches corresponding to the latch signals 4110-3, 4110-4 and 4110-5 thereafter. By repeating this operation, display data 4101 for one line portion is stored so as to be partially duplicated at the data latch 4111. The display data of the data latch 4111 is simultaneously captured and stored at the line data latch 4113 using the horizontal data synchronization signal 4104, and display data for the line data latch 4113 is stored at the line data latch 4115 using the synchronization signal 4106. A gradation voltage is then outputted to the drain line group 4118 based on the display data of the line data latch 4115.

On the other hand, as shown in FIG. 39, the operation of the scanning driver is the same as for the fifth embodiment (refer to FIG. 35), with the exception of the horizontal data synchronization signal 4104 of the line data latch 4113 having a period 1.25 times the period of the horizontal scanning period signal 4106 of the line data latch 4115.

When the line scan start signal 4801 becomes valid, a select voltage is outputted to the gate line for the leading line within the gate line group 4809 and a de-select voltage is outputted to the remaining gate lines. The gate line to which a select voltage is outputted is then sequentially transferred in synchronization with the shift clock 4802 from the gate line for the leading line to the gate line for the final line. The shift clock 4802 then also updates the gradation voltage outputted by the liquid crystal driver 4903 every time the gate line to which the select voltage is outputted is transferred, in synchronization with the horizontal scanning period signal 4106 supplied to the line data latch 4115 of the liquid crystal driver 4903. However, because the horizontal data synchronization signal 4104 of the line data latch 4113 has a period of 1.25 times the period of the horizontal scanning period signal 4106 of the line data latch 4115, when the line scan start signal 4801 becomes valid the liquid crystal driver 4903 outputs gradation voltages based on the same one line portion of display data L(1) in the first two periods of the horizontal scanning period signal 4106 and then outputs gradation voltages based on the one line portions of display data L(2), L(3) and L(4) in the subsequent three periods. As a result, a display expressing display data of 640 dots by 480 lines can be displayed enlarged by 1.25 times in the horizontal and vertical directions. This display is the same as the display described in the second embodiment using FIG. 13, FIG. 14A and FIG. 14B.

When the resolution of the image expressed by the inputted display data 4101 is the same as the resolution of the liquid crystal panel 4906, normal displaying can be performed at the same rate with the liquid crystal display of this embodiment also by switching the state of the selector 4702 of the shift register shown in FIG. 37. As in the case of the fifth embodiment, this sixth embodiment can also be applied to a liquid crystal display for displaying at an arbitrary rate of enlargement or color displaying.

In the above fifth and sixth embodiments images expressed by low resolution display data can be enlarged and displayed as normal. By then selecting gate lines sequentially one at a time, display panels where a plurality of gate lines cannot be selected at the same time can be utilized and cheaper related scanning drivers can be utilized as the scanning driver 4904.

According to the present invention described above, display data can be enlarged so as to be displayed in a natural manner even when the resolution of the inputted display data is lower than the resolution of the liquid crystal panel. An enlarged display of a higher picture quality is also possible in this case by giving weightings during the generation of interpolated pixels.

Further, it is not necessary to change related systems for generating display data or related liquid crystal panels for this enlargement processing to be carried out at liquid crystal drivers and scanning drivers, and devices for the present invention can therefore be made cheaply.

According to the present invention, the above enlargement processing can be carried out utilizing liquid crystal panels that are not capable of selecting two neighboring horizontal lines simultaneously.

What is claimed is:

1. A liquid crystal display device for displaying an image represented by display data comprising a plurality of pixel data that is sequentially inputted, comprising:

a liquid crystal panel having a plurality of pixel display units arranged in M rows and N columns;

a gray-scale driver having N pixel data latch circuits provided respectively to each of N columns of said liquid crystal panel, and for supplying gray-scale voltages in accordance with pixel data latched by each of said N pixel data latching circuits, respectively, to corresponding columns of said liquid crystal panel, whereby the gray-scale voltages corresponding to one horizontal line are supplied in parallel to said liquid crystal panel;

a scanning driver for selecting a line of said liquid crystal panel, which is to be supplied with the gray-scale voltages for one horizontal line, outputted by said gray-scale driver; and a control circuit for generating a first control signal to be provided to said gray-scale driver and a second control signal to be provided to said scanning driver, on the basis of said display data and a sync signal thereof; wherein, according to said first control signal, said plurality of pixel data sequentially inputted from outside are latched into said pixel data latch circuits in sequence;

according to said second control signal, said scanning driver sequentially selects a line of said liquid crystal panel, the line being supplied with the gray-scale voltages corresponding to one horizontal line, outputted by said gray-scale driver; and said control circuit generates said first control signal so that at least one pixel data is latched into at least two of said plurality of pixel data latch circuits, when a pixel data number V for one horizontal line of said display data is smaller than N, and generates said second control signal so that the gray-scale voltages for at least one horizontal line are supplied into a plurality of lines of the liquid crystal panel, when a pixel data number H for one vertical line is smaller than M.

2. A liquid crystal display device according to claim 1, wherein said at least two of said plurality of pixel data latch circuits are arranged so that the corresponding columns are neighboring.

3. A liquid crystal display device according to claim 1, further comprising changing means for changing the number of said plurality of pixel data latch circuits simultaneously latching the same piece of pixel data.

4. A liquid crystal display device according to claim 1, further comprising selected line number changing means for changing a number of lines simultaneously selected by said scanning driver.

5. A liquid crystal display device according to claim 1, wherein said plurality of lines of the liquid crystal panel are neighboring.

* * * * *